US009657913B2

(12) United States Patent
Wang

(10) Patent No.: US 9,657,913 B2
(45) Date of Patent: May 23, 2017

(54) VEHICLE LAMP MODULE

(71) Applicant: ADI OPTICS CO., LTD., New Taipei (TW)

(72) Inventor: Cheng Wang, Taipei (TW)

( * ) Notice: Subject to any disclaimer, the term of this patent is extended or adjusted under 35 U.S.C. 154(b) by 244 days.

(21) Appl. No.: 14/688,016

(22) Filed: Apr. 16, 2015

(65) Prior Publication Data

US 2015/0300588 A1 Oct. 22, 2015

(30) Foreign Application Priority Data

Apr. 18, 2014 (TW) ..... 103114200 A

(51) Int. Cl.
*F21V 7/00* (2006.01)
*F21S 8/10* (2006.01)

(52) U.S. Cl.
CPC ..... *F21S 48/1388* (2013.01); *F21S 48/1154* (2013.01); *F21S 48/1159* (2013.01); *F21S 48/1258* (2013.01); *F21S 48/137* (2013.01); *F21S 48/1323* (2013.01); *F21S 48/145* (2013.01)

(58) Field of Classification Search
CPC .. F21S 48/115; F21S 48/1159; F21S 48/1154; F21S 48/1163; F21S 48/1195; F21S 48/125; F21S 48/1323; F21S 48/1335; F21S 48/1341; F21S 48/1347; F21S 48/1352; F21S 48/1358; F21S 48/137; F21S 48/1364; F21S 48/1376; F21S 48/1382; F21S 48/1388
USPC ..... 316/516
See application file for complete search history.

(56) References Cited

U.S. PATENT DOCUMENTS

2012/0039083 A1* 2/2012 Meyrenaud ..... F21S 48/1159 362/516
2014/0313760 A1* 10/2014 Yagi ..... F21S 48/125 362/520

* cited by examiner

*Primary Examiner* — Andrew Coughlin
*Assistant Examiner* — Matthew Peerce
(74) *Attorney, Agent, or Firm* — Li & Cai Intellectual Property (USA) Office

(57) ABSTRACT

Disclosed is a vehicle lamp module, including a lamp cup structure, a light-emitting structure, and a lens structure. The lamp cup structure has multiple light-focusing curved surfaces, where each of the light-focusing curved surfaces has a first focal point and a second focal point, and the first focal point and the second focal point of each light-focusing curved surface are located on an axis of the light-focusing curved surface. The light-emitting structure includes multiple light-emitting elements, where each of the light-emitting elements is disposed corresponding to the first focal point of a corresponding one of the light-focusing curved surfaces. The lens structure has a lens focal point, a primary optical axis, and a reference line, where the lens focal point is located at an intersection point of the primary optical axis and the reference line and the reference line is parallel to the lens structure.

11 Claims, 17 Drawing Sheets

VEHICLE LAMP MODULE

TECHNICAL FIELD

The present disclosure relates to a vehicle lamp module, and in particular, to a vehicle lamp module with multiple light-focusing curved surfaces.

BACKGROUND ART

Light-emitting modules of conventional vehicle headlamps may be classified into tungsten halogen lamps and High Intensity Discharge (HID) lamps, where the tungsten halogen lamp has an arc length of 5.6 mm and the HID lamp has an arc length of 4.3 mm. In order to match with traditional illumination lamp sources, a Projector Ellipsoid System (PES) is most often used as a light-focusing system, where a lamp cup has the characteristic of a single optical axis and a single light-emitting module. At present, in order to match the arc lengths and sizes of a tungsten halogen lamp and an HID lamp, a light-emitting diode module disposed in the vehicle headlamp adopts a continuous light-emitting diode packaging process. However, because a single elliptical lamp cup only has a single focal point, only a single light-emitting module can be used. Therefore, light-emitting diodes having a size of 1 mm×1 mm are most often adopted as the base of package at present. The continuous light-emitting diode packaging process means that light-emitting diodes are packaged on a same silicon substrate through a eutectic process or another process, so that the distance between the edges of the light-emitting diodes may be 0.1 mm and may even be as small as 0.05 mm. Because the space between the light-emitting diodes is small, the light-emitting diodes may be regarded as a single light source. However, with the same brightness, the cost of the continuous light-emitting diode package is at least 10 times more than a common light-emitting diode manufactured through a common process.

Meanwhile, when the common light-emitting diode manufactured through the common process is mounted in a conventional vehicle lamp module, due to the design of the lamp cup of the conventional vehicle lamp module, a light source emitted by the conventional vehicle lamp module cannot meet relevant regulations such as ECE R112 in the Regulations of United Nations Economic Commission for Europe (ECE regulations for short) and the SAE J1383 regulation for the vehicle lamp standard of the Society of Automotive Engineering. For example, a common light-emitting diode has a large package size and cannot be packaged and be used as a single light source, and light-emitting diodes thereof are mounted on a Metal Core Printed Circuit Board (MCPCB). Generally, a minimum edge distance of the light-emitting diodes is 0.15 mm to 0.2 mm. A minimum weldable spacing of the light-emitting diodes in a tin soldering process is 0.1 mm to 0.2 mm. Therefore, if common illumination light-emitting diodes each having a size of 1 mm×1 mm are discretely arranged and the distance between adjacent ones in the light-emitting diodes is 0.5 mm, multiple light sources are thus formed, thus failing to meet the regulatory requirements.

SUMMARY OF THE INVENTION

In view of the above problems, the present disclosure provides a vehicle lamp module having multiple light-focusing curved surfaces, through the design of a configuration relationship between a lamp cup and light-emitting diodes, which is adapted for light-emitting diodes made by a common process, so that the problems in the prior art are avoided, the manufacturing cost is reduced, and relevant regulations such as ECE R112 in the Regulations of United Nations Economic Commission for Europe (called ECE regulations for short) and the SAE J1383 regulation for the vehicle lamp standard of the Society of Automotive Engineering are met.

In order to achieve the above objective, an embodiment of the present disclosure provides a vehicle lamp module including a lamp cup structure, a light-emitting structure, and a lens structure. The lamp cup structure has a first light-focusing curved surface, a second light-focusing curved surface, a third light-focusing curved surface, and a fourth light-focusing curved surface, where the first light-focusing curved surface has a first focal point and a second focal point, the second light-focusing curved surface has a third focal point and a fourth focal point, the third light-focusing curved surface has a fifth focal point and a sixth focal point, and the fourth light-focusing curved surface has a seventh focal point and an eighth focal point. The first focal point and the second focal point are located on a first axis, the third focal point and the fourth focal point are located on a second axis, the fifth focal point and the sixth focal point are located on a third axis, and the seventh focal point and the eighth focal point are located on a fourth axis. The light-emitting structure includes a first light-emitting element, a second light-emitting element, a third light-emitting element, and a fourth light-emitting element, where the first light-emitting element corresponds to the first focal point, the second light-emitting element corresponds to the third focal point, the third light-emitting element corresponds to the fifth focal point, and the fourth light-emitting element corresponds to the seventh focal point. The lens structure has a lens focal point, a primary optical axis, and a reference line, where the lens focal point is located at an intersection point of the primary optical axis and the reference line and the reference line is parallel to the lens structure. The second focal point, the fourth focal point, the sixth focal point, and the eighth focal point are all located on the reference line. A first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, a third light source generated by the third light-emitting element is projected onto the third light-focusing curved surface to form a third reflection light source corresponding to the sixth focal point, and a fourth light source generated by the fourth light-emitting element is projected onto the fourth light-focusing curved surface to form a fourth reflection light source corresponding to the eighth focal point.

Another embodiment of the present disclosure provides a vehicle lamp module including a lamp cup structure, a light-emitting structure, and a lens structure. The lamp cup structure having a first light-focusing curved surface, a second light-focusing curved surface, a third light-focusing curved surface, a fourth light-focusing curved surface, a first reflecting plate, and a second reflecting plate, where the first reflecting plate is disposed between the first light-focusing curved surface and the second light-focusing curved surface to connect the first light-focusing curved surface and the second light-focusing curved surface, and the second reflecting plate is disposed between the third light-focusing curved surface and the fourth light-focusing curved surface to connect the third light-focusing curved surface and the fourth light-focusing curved surface. The first light-focusing curved surface has a first focal point and a second focal point, the second light-focusing curved surface has a third focal point and a fourth focal point, the third light-focusing curved surface has a fifth focal point and a sixth focal point, and the fourth light-focusing curved surface has a seventh focal point and an eighth focal point. The first focal point and the second focal point are located on a first axis, the third focal point and the fourth focal point are located on a second axis, the fifth focal point and the sixth focal point are located on a third axis, and the seventh focal point and the eighth focal point are located on a fourth axis. The light-emitting structure includes a first light-emitting element, a second light-emitting element, a third light-emitting element, and a fourth light-emitting element, where the first light-emitting element corresponds to the first focal point, the second light-emitting element corresponds to the third focal point, the third light-emitting element corresponds to the fifth focal point, and the fourth light-emitting element corresponds to the seventh focal point. The lens structure has a lens focal point, a primary optical axis, and a reference line, where the lens focal point is located at an intersection point of the primary optical axis and the reference line and the reference line is parallel to the lens structure. The second focal point, the fourth focal point, the sixth focal point, and the eighth focal point are all located on the reference line. A first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, a third light source generated by the third light-emitting element is projected onto the third light-focusing curved surface to form a third reflection light source corresponding to the sixth focal point, and a fourth light source generated by the fourth light-emitting element is projected onto the fourth light-focusing curved surface to form a fourth reflection light source corresponding to the eighth focal point.

Still another embodiment of the present disclosure provides a vehicle lamp module including a lamp cup structure, a light-emitting structure, and a lens structure. The lamp cup structure has a first light-focusing curved surface, a second light-focusing curved surface, and a third light-focusing curved surface, where the first light-focusing curved surface has a first focal point and a second focal point, the second light-focusing curved surface has a third focal point and a fourth focal point, and the third light-focusing curved surface has a fifth focal point and a sixth focal point. The first focal point and the second focal point are located on a first axis, the third focal point and the fourth focal point are located on a second axis, and the fifth focal point and the sixth focal point are located on a third axis. The light-emitting structure includes a first light-emitting element, a second light-emitting element, and a third light-emitting element, where the first light-emitting element corresponds to the first focal point, the second light-emitting element corresponds to the third focal point, and the third light-emitting element corresponds to the fifth focal point. The lens structure has a lens focal point, a primary optical axis, and a reference line, where the lens focal point is located at an intersection point of the primary optical axis and the reference line and the reference line is parallel to the lens structure. The second focal point, the fourth focal point, and the sixth focal point are all located on the reference line. A first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, and a third light source generated by the third light-emitting element is projected onto the third light-focusing curved surface to form a third reflection light source corresponding to the sixth focal point.

The beneficial effects of the present disclosure are that, through the design of the lamp cup, the vehicle lamp module provided by the embodiments of the present disclosure is adapted for a vehicle lamp module with discontinuous light-emitting modules, so that the problems in the prior art are avoided, the manufacturing cost is reduced, and relevant regulations such as ECE R112 in the Regulations of United Nations Economic Commission for Europe (called ECE regulations for short) and the SAE J1383 regulation for the vehicle lamp standard of the Society of Automotive Engineering are met. Moreover, the vehicle lamp module provided by the embodiments of the present disclosure is especially adapted for a high-beam lamp structure.

In order to further understand the features and technical content of the present disclosure, reference may be made to the following detailed description and accompanying drawings of the present disclosure. However, the accompanying drawings are only provided for reference and description, but are not intended to limit the present disclosure.

DETAILED DESCRIPTION OF THE PREFERRED EMBODIMENTS

Implementation of a vehicle lamp module disclosed in the present disclosure is illustrated by the following specific examples. Other advantages and effects of the present disclosure can be easily understood by persons skilled in the art from the content disclosed in the specification. The present disclosure may also be implemented or applied in other different specific embodiments. Details in the specification may also be modified or changed based on different ideas and applications without departing from the spirit of the present disclosure. It should be noted that, the drawings of the present disclosure are only simply illustrated and are not drawn in scale, that is, do not reflect the actual sizes of the relevant components. The following detailed description further describes the relevant technical content of the present disclosure, but is not intended to limit the technical scope of the present disclosure.

First Embodiment

Figure 1A:
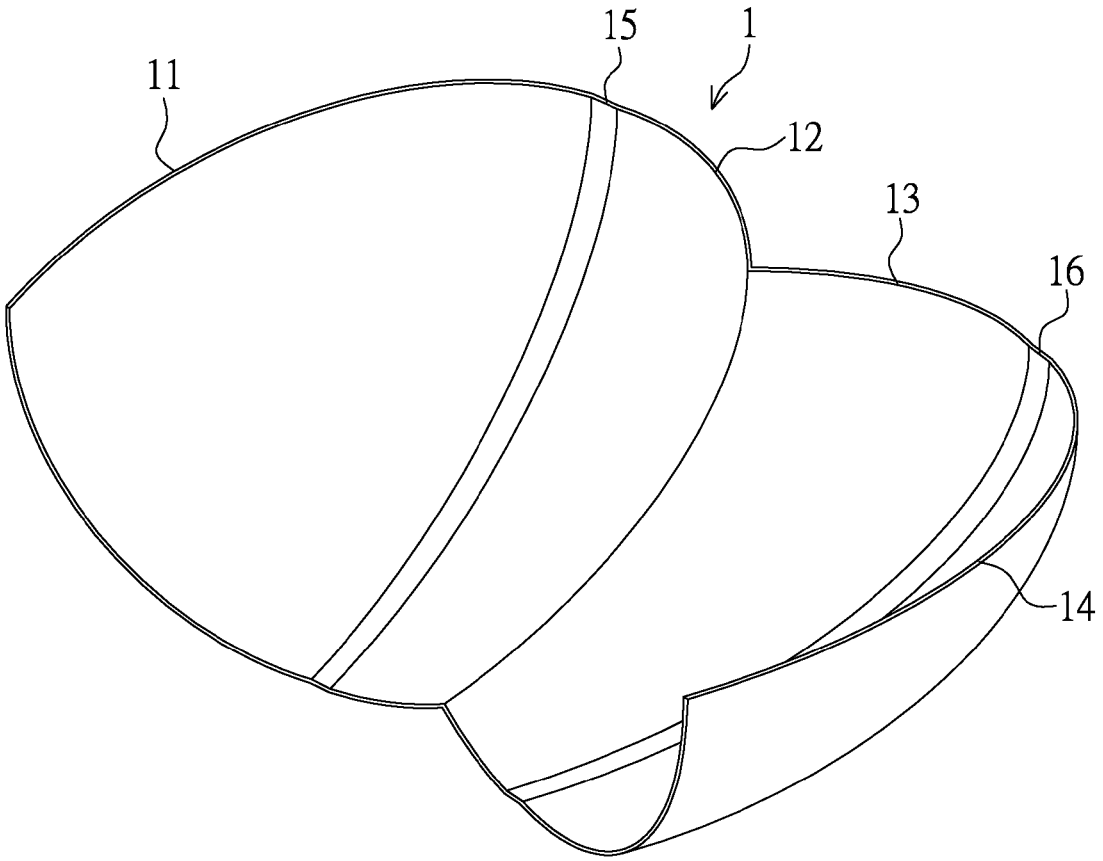
FIG. 1A is a schematic perspective view according to a first embodiment of the present disclosure.
Figure 1B:
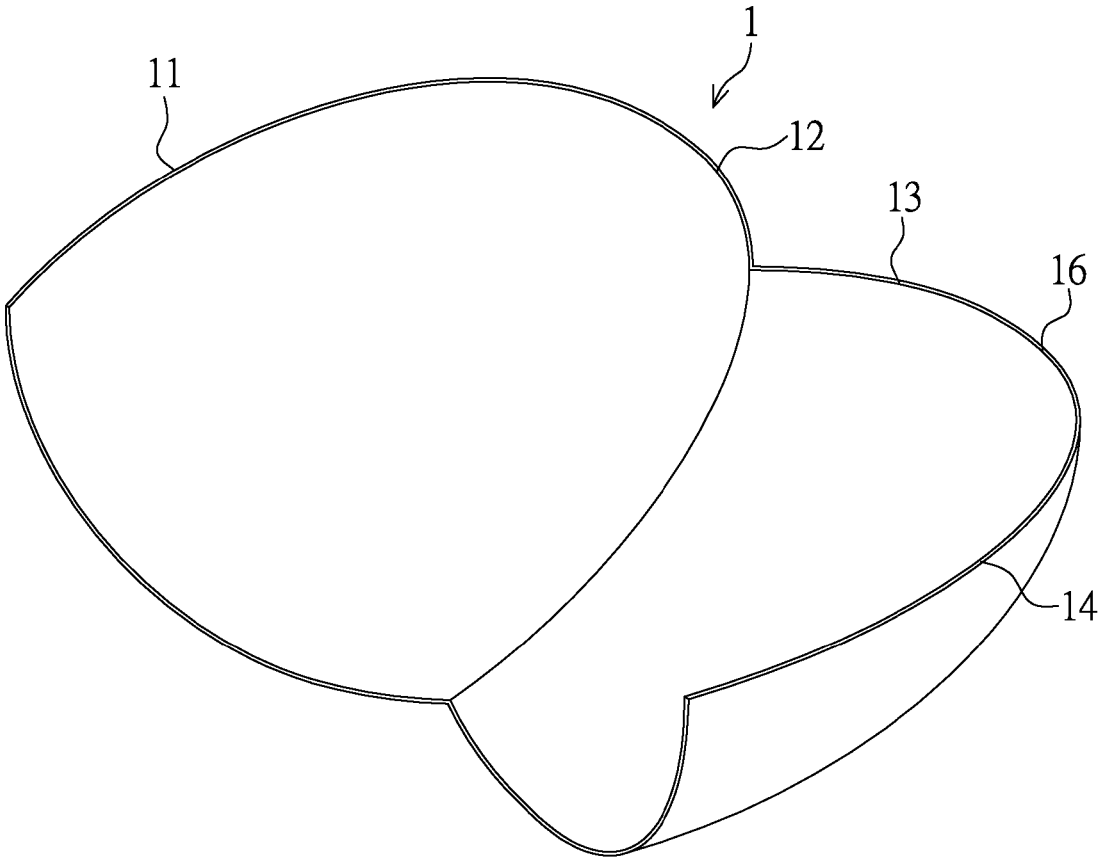
FIG. 1B is another schematic perspective view according to the first embodiment of the present disclosure.

Firstly, referring to FIG. 1A to FIG. 1E, a first embodiment of the present disclosure provides a vehicle lamp module C, including a lamp cup structure (or lamp reflector structure) 1, a light-emitting structure 2, and a lens structure 3. As shown in FIG. 1A, the lamp cup structure 1 may consist of multiple curved surfaces with different curvatures. For example, the lamp cup structure may be formed of ellipse-based curved surfaces with different curvatures. In the first embodiment of the present disclosure, the lamp cup structure 1 has a first light-focusing curved surface 11, a second light-focusing curved surface 12, a third light-focusing curved surface 13, and a fourth light-focusing curved surface 14, where the lamp cup structure 1 may further have a first light-diffusing curved surface 15 disposed or connected between the first light-focusing curved surface 11 and the second light-focusing curved surface 12 and a second light-diffusing curved surface 16 disposed or connected between the third light-focusing curved surface 13 and the fourth light-focusing curved surface 14. Alternatively, as shown in FIG. 1B, the first light-focusing curved surface 11, the second light-focusing curved surface 12, the third light-focusing curved surface 13, and the fourth light-focusing curved surface 14 are directly connected to each other, but the present disclosure is not limited thereto.

Figure 1C:
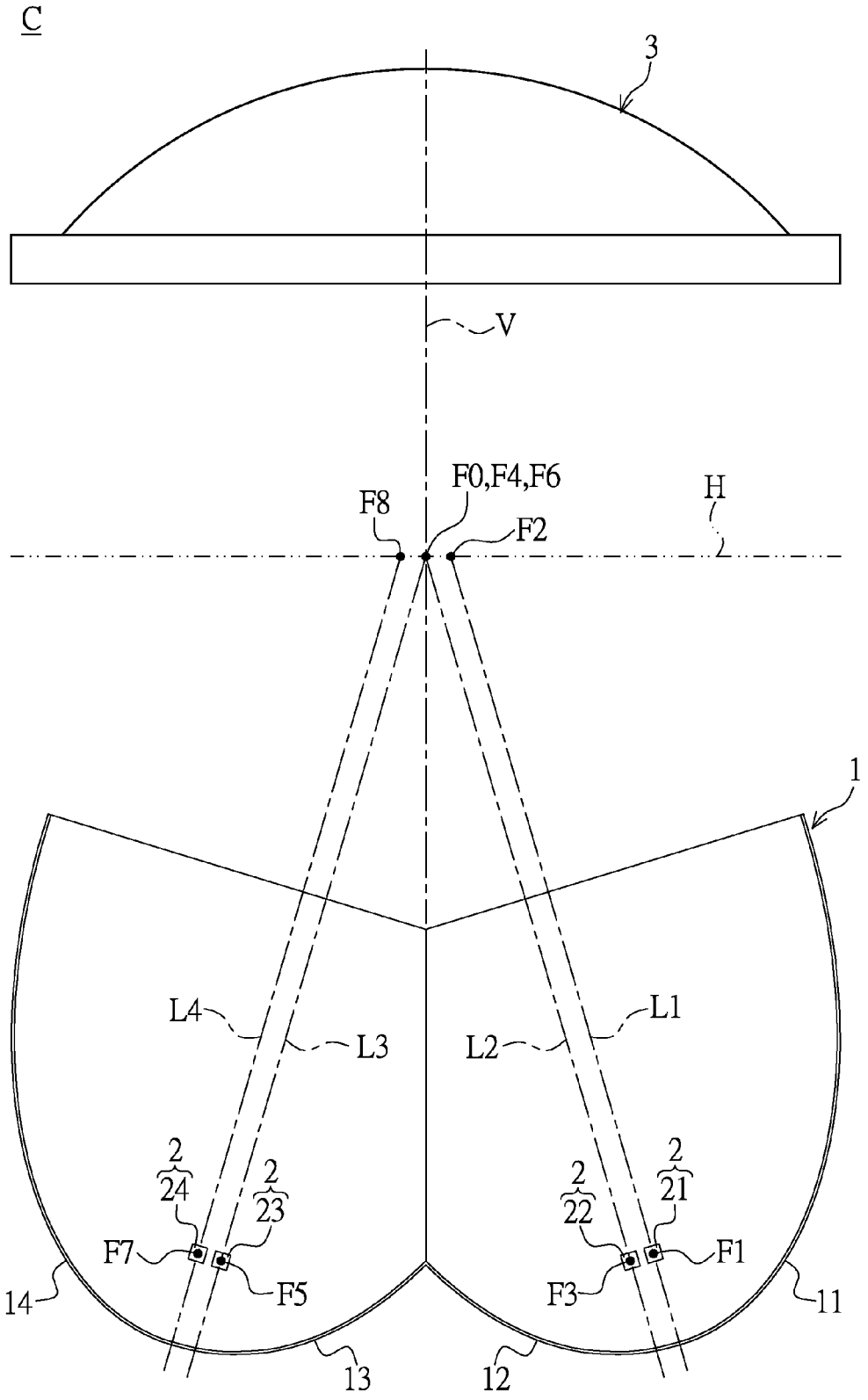
FIG. 1C is a schematic top view according to the first embodiment of the present disclosure.

Then, referring to FIG. 1C, a schematic top view of FIG. 1B is shown. The first light-focusing curved surface 11 has a first focal point F1 and a second focal point F2, the second light-focusing curved surface 12 has a third focal point F3 and a fourth focal point F4, the third light-focusing curved surface 13 has a fifth focal point F5 and a sixth focal point F6, and the fourth light-focusing curved surface 14 has a seventh focal point F7 and an eighth focal point F8. The first focal point F1 and the second focal point F2 are located on a first axis L1, the third focal point F3 and the fourth focal point F4 are located on a second axis L2, the fifth focal point F5 and the sixth focal point F6 are located on a third axis L3, and the seventh focal point F7 and the eighth focal point F8 are located on a fourth axis L4. In other words, the first axis L1, the second axis L2, the third axis L3, and the fourth axis L4 are each formed by connecting the focal points of the respective light-focusing curved surfaces.

Further, the light-emitting structure 2 may be disposed in the lamp cup structure 1, where the light-emitting structure 2 includes a first light-emitting element 21, a second light-emitting element 22, a third light-emitting element 23, and a fourth light-emitting element 24. For example, the first light-emitting element 21, the second light-emitting element 22, the third light-emitting element 23, and the fourth light-emitting element 24 are light-emitting diodes, where the first light-emitting element 21, the second light-emitting element 22, the third light-emitting element 23, and the fourth light-emitting element 24 may adopt light-emitting diodes with different color temperatures or colored light to adjust a light source emitted by the light-emitting structure 2. The first light-emitting element 21 may correspond to the first focal point F1 of the first light-focusing curved surface 11, the second light-emitting element 22 may correspond to the third focal point F3 of the second light-focusing curved surface 12, the third light-emitting element 23 may correspond to the fifth focal point F5 of the third light-focusing curved surface 13, and the fourth light-emitting element 24 may correspond to the seventh focal point F7 of the fourth light-focusing curved surface 14. Moreover, the lamp cup structure 1 and the light-emitting structure 2 may cooperate with a lens structure 3. For the vehicle lamp module C, a plano-convex lens may be used as the lens structure 3. The lens structure 3 may have a lens focal point F0, a primary optical axis V, and a reference line H. The lens focal point F0 is located at an intersection point of the primary optical axis V and the reference line H. The distance between the lens structure 3 and the reference line H is the distance from the lens focal point F0 to the lens structure 3. The primary optical axis V and the reference line H are disposed in perpendicular to each other and the reference line H and the lens structure 3 are disposed in parallel to each other. Due to the characteristics of the ellipse-based light-focusing curved surfaces, the second focal point F2, the fourth focal point F4, the sixth focal point F6, and the eighth focal point F8 in the lamp cup structure 1 are all located on the reference line H of the lens structure 3. Therefore, when a first light source generated by the first light-emitting element 21 is projected onto the first light-focusing curved surface 11, the first light source is reflected by the first light-focusing curved surface 11, forming a first reflection light source corresponding to the second focal point F2; when a second light source generated by the second light-emitting element 22 is projected onto the second light-focusing curved surface 12, the second light source is reflected by the second light-focusing curved surface 12, forming a second reflection light source corresponding to the fourth focal point F4; when a third light source generated by the third light-emitting element 23 is projected onto the third light-focusing curved surface 13, the third light source is reflected by the third light-focusing curved surface 13, forming a third reflection light source corresponding to the sixth focal point F6; and when a fourth light source generated by the fourth light-emitting element 24 is projected onto the fourth light-focusing curved surface 14, the fourth light source is reflected by the fourth light-focusing curved surface 14, forming a fourth reflection light source corresponding to the eighth focal point F8.

In the first embodiment of the present disclosure, the first light-emitting element 21 may be directly disposed at the first focal point F1, the second light-emitting element 22 may be directly disposed at the third focal point F3, the third light-emitting element 23 may be directly disposed at the fifth focal point F5, and the fourth light-emitting element 24 may be directly disposed at the seventh focal point F7. Therefore, when the first light source generated by the first light-emitting element 21 is projected onto the first light-focusing curved surface 11, a first reflection light source through the second focal point F2 is formed; when the second light source generated by the second light-emitting element 22 is projected onto the second light-focusing curved surface 12, a second reflection light source through the fourth focal point F4 is formed; when the third light source generated by the third light-emitting element 23 is projected onto the third light-focusing curved surface 13, a third reflection light source through the sixth focal point F6 is formed; and when the fourth light source generated by the fourth light-emitting element 24 is projected onto the fourth light-focusing curved surface 14, a fourth reflection light source through the eighth focal point F8 is formed. Therefore, the lens focal point F0 converges with the fourth focal point F4 and the sixth focal point F6, and the second focal point F2 and the eighth focal point F8 are adjacent to two sides of the lens focal point F0 respectively. The first reflection light source, the second reflection light source, the third reflection light source, and the fourth reflection light source projected onto the reference line H of the lens structure 3 through the first light-emitting element 21, the second light-emitting element 22, the third light-emitting element 23, and the fourth light-emitting element 24 form a continuous light source in which the three points are connected to each other for the lens structure 3. Also, because the light sources formed by the second light-emitting element 22 and the third light-emitting element 23 are projected onto the lens focal point F0 of the lens structure 3 along the second axis L2 and the third axis L3, the light source projected by the lens structure 3 is brightest in the middle.

For example, in this case, the first light-focusing curved surface 11 has a focusing function for the first light-emitting element 21 and has a light-diffusing function for the second light-emitting element 22, the third light-emitting element 23, and the fourth light-emitting element 24. In contrast, the second light-focusing curved surface 12 has a focusing function for the second light-emitting element 22 and has a light-diffusing function for the first light-emitting element 21, the third light-emitting element 23, and the fourth light-emitting element 24. The third light-focusing curved surface 13 has a focusing function for the third light-emitting element 23 and has a light-diffusing function for the first light-emitting element 21, the second light-emitting element 22, and the fourth light-emitting element 24. The fourth light-focusing curved surface 14 has a focusing function for the third light-emitting element 24 and has a light-diffusing function for the first light-emitting element 21, the second light-emitting element 22, and the third light-emitting element 23. It is noted that, when the lamp cup structure 1 further includes a first light-diffusing curved surface 15 and a second light-diffusing curved surface 16, the first light-diffusing curved surface 15 and the second light-diffusing curved surface 16 have a light-diffusing function for the first light-emitting element 21, the second light-emitting element 22, the third light-emitting element 23, and the fourth light-emitting element 24.

It is noted that, the curvatures of the light-focusing curved surfaces of the vehicle lamp module C may also be changed, so that the lens focal point F0 converges with the second focal point F2 of the first light-focusing curved surface 11 and the eighth focal point F8 of the fourth light-focusing curved surface 14, and the fourth focal point F4 of the second light-focusing curved surface 12 and the sixth focal point F6 of the third light-focusing curved surface 13 are adjacent to the two sides of the lens focal point F0. Moreover, depending on the design of positions of the focal points of the light-focusing curved surfaces in the lamp cup structure 1, the first light-emitting element 21 may also be disposed adjacent to the first focal point F1, the second light-emitting element 22 may also be disposed adjacent to the third focal point F3, the third light-emitting element 23 may also be disposed adjacent to the fifth focal point F5, and the fourth light-emitting element 24 may also be disposed adjacent to the seventh focal point F7.

Figure 1D:
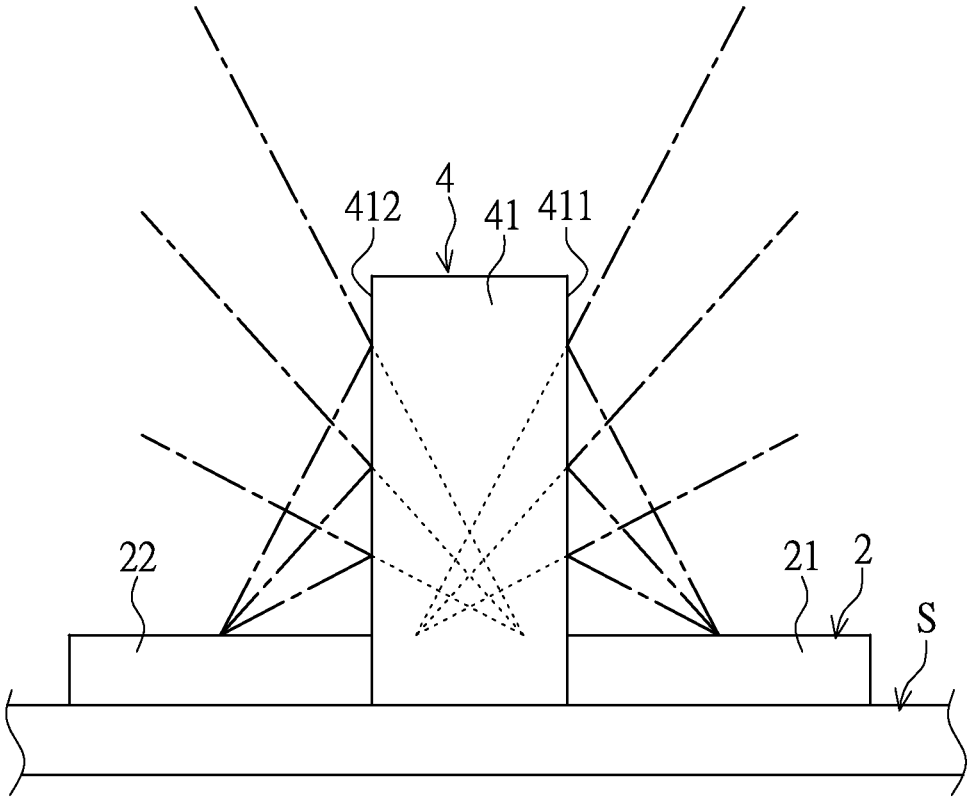
FIG. 1D is a schematic side view according to the first embodiment of the present disclosure.
Figure 1E:
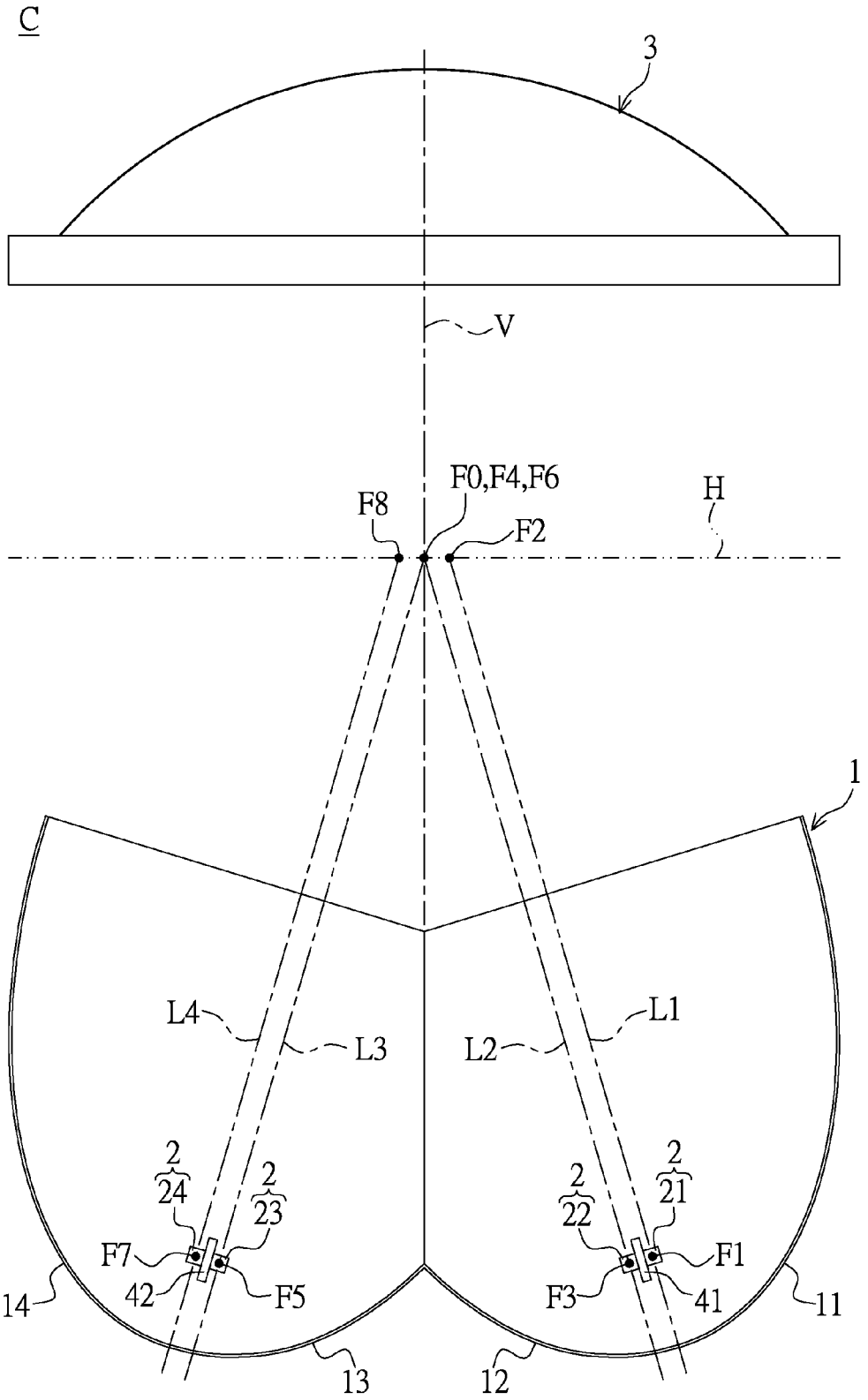
FIG. 1E is another schematic top view according to the first embodiment of the present disclosure.

Then, referring to FIG. 1D and FIG. 1E, the vehicle lamp module C may further include a reflection structure 4. The reflection structure 4 may include a first reflecting mirror 41 and a second reflecting mirror 42. The first reflecting mirror 41 may be disposed between the first light-emitting element 21 and the second light-emitting element 22, and the second reflecting mirror 42 may be disposed between the third light-emitting element 23 and the fourth light-emitting element 24. As shown in FIG. 1D, the first reflecting mirror 41 is disposed between the first light-emitting element 21 and the second light-emitting element 22, and has a first reflecting surface 411 and a second reflecting surface 412. The first reflecting surface 411 faces the first light-emitting element 21, and the second reflecting surface 412 faces the second light-emitting element 22. The first light-emitting element 21 and the second light-emitting element 22 may be disposed on a substrate S. The first reflecting mirror 41 is disposed such that a virtual image of the first light-emitting element 21 is presented in the first reflecting surface 411 and a virtual image of the second light-emitting element 22 is presented in the second reflecting surface 412, and thus a light source reflected by the first reflecting surface 411 is regarded as the first light source generated by the first light-emitting element 21 and a light source reflected by the second reflecting surface 412 is regarded as the second light source generated by the second light-emitting element 22. In other words, discrete light sources originally separated from a predetermined distance become a continuous light-emitting light source through connection by the reflection structure 4. As shown in FIG. 1E, the vehicle lamp module C with the reflection structure 4 added has higher light-focusing efficiency compared with the vehicle lamp module C shown in FIG. 1C. Meanwhile, because the light source emitted through the reflection structure 4 is not located at the focal points of the light-focusing curved surfaces, a better light-focusing effect can be provided for light sources projected adjacent to the lens focal point F0.

Moreover, a control module may be used to control the first light-emitting element 21, the second light-emitting element 22, the third light-emitting element 23, and the fourth light-emitting element 24, and thus control the light distribution pattern, color temperature or colored light of the light source emitted by the light-emitting structure 2. Therefore, if light-emitting diodes with different colored light are used in combination, a light source with a different color can be obtained. Taking a white light as an example, a warm white light of 3000 K may be mixed with a blue light of about 460 nm, and a white light with another color temperature can be obtained. Alternatively, a warm white light of 3000 K may also be mixed with a cold white light of 6500 K to obtain a colored light of about 4000 K. It is noted that, the vehicle lamp module C may further include a cut-off line shielding plate. The cut-off line shielding plate may be disposed adjacent to or directly at the lens focal point F0 of the lens structure 3, to control the distribution pattern of the light emitted by the vehicle lamp module C.

Because the curvatures of the first light-focusing curved surface 11, the second light-focusing curved surface 12, the third light-focusing curved surface 13, and the fourth light-focusing curved surface 14 in the lamp cup structure 1 may be designed and the light-emitting structure 2 may be correspondingly disposed at the focal points of the first light-focusing curved surface 11, the second light-focusing curved surface 12, the third light-focusing curved surface 13, and the fourth light-focusing curved surface 14, the vehicle lamp module C provided in the first embodiment of the present disclosure can be especially applicable to a vehicle lamp module C with discrete light sources, so that relevant regulations are met, the manufacturing cost is reduced, and the illuminance, the lumens, and the projection distance of the light source are improved.

Second Embodiment

Figure 2A:
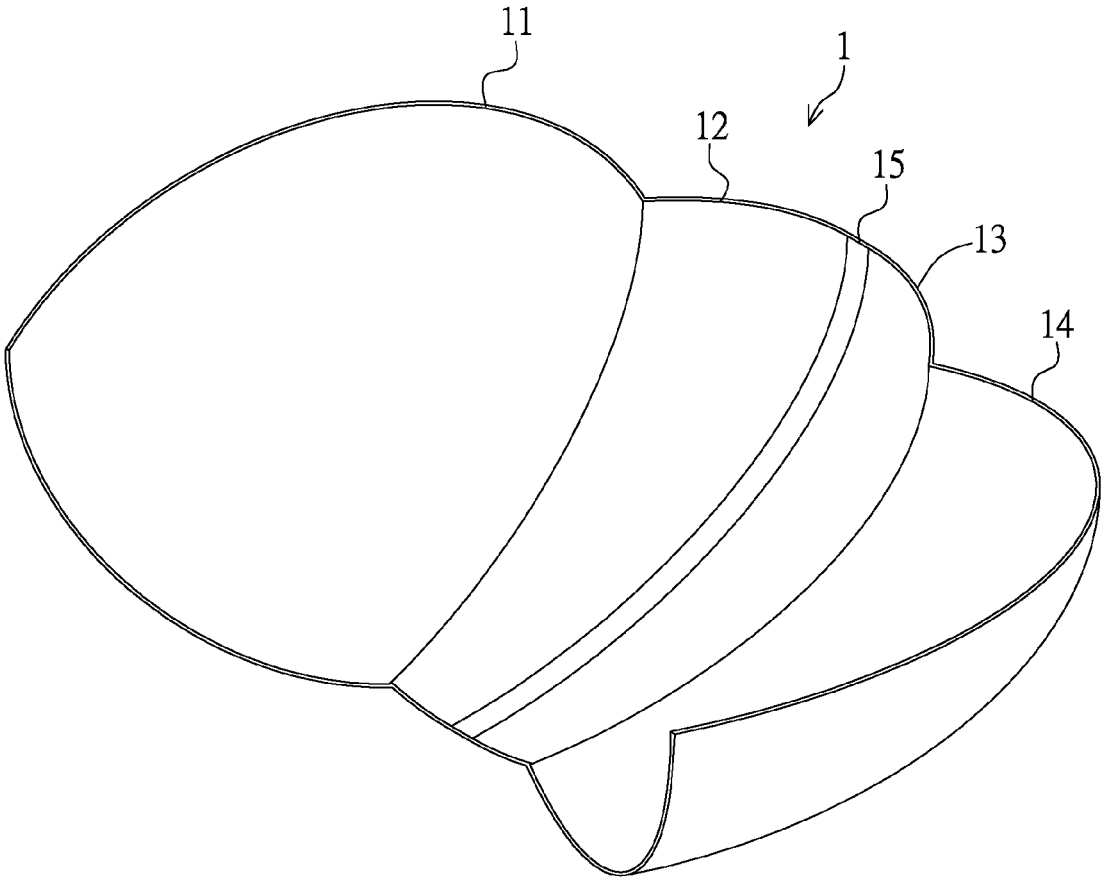
FIG. 2A is a schematic perspective view according to a second embodiment of the present disclosure.
Figure 2B:
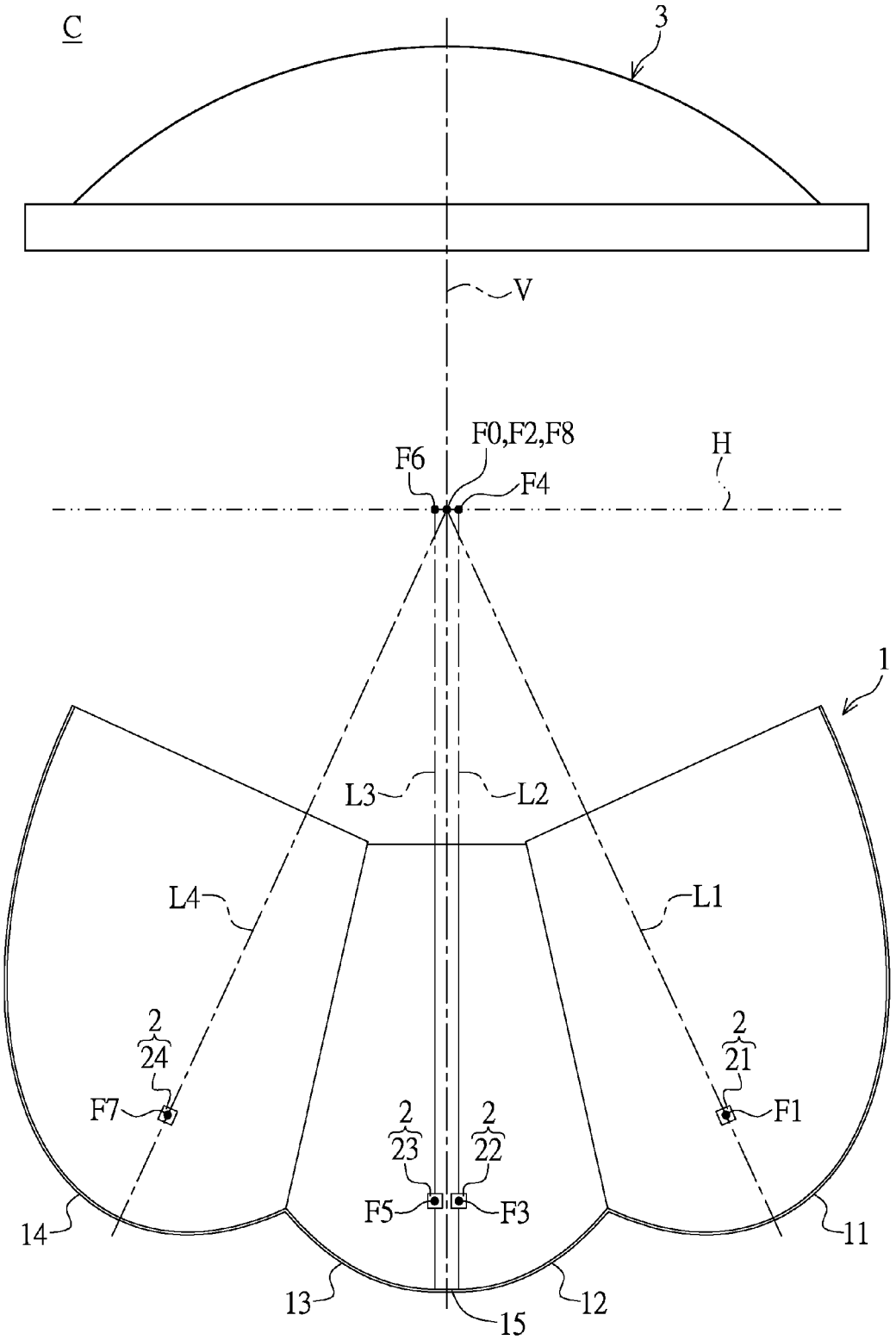
FIG. 2B is a schematic top view according to the second embodiment of the present disclosure.
Figure 2C:
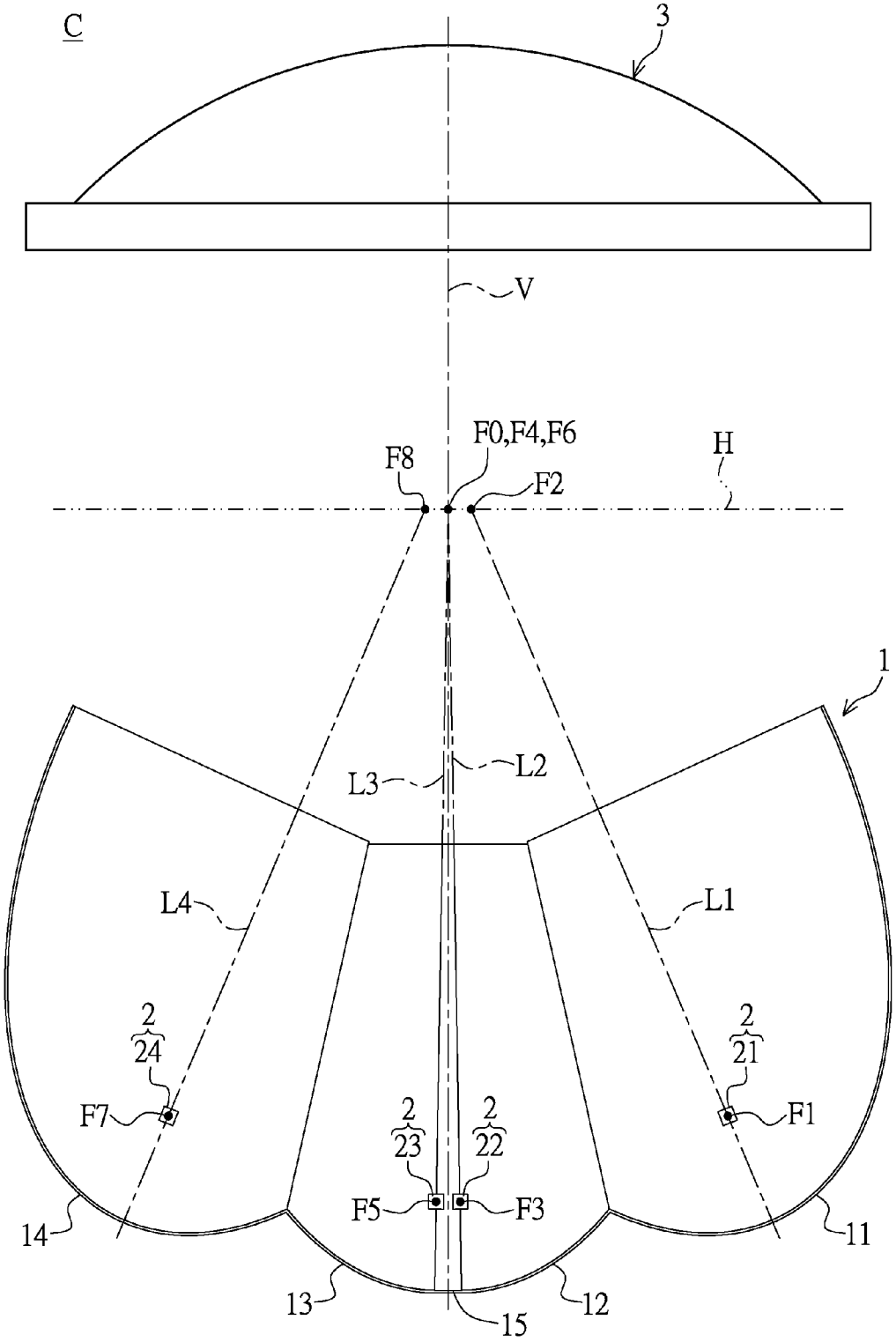
FIG. 2C is another schematic top view according to the second embodiment of the present disclosure.

Firstly, referring to FIG. 2A to FIG. 2C, a second embodiment of the present disclosure provides a vehicle lamp module C, including a lamp cup structure 1, a light-emitting structure 2, and a lens structure 3. As shown in FIG. 2A, the lamp cup structure 1 may consist of multiple curved surfaces with different curvatures. For example, the lamp cup structure 1 may be formed of ellipse-based curved surfaces with different curvatures. It can be understood by comparing FIG. 2A and FIG. 2B with FIG. 1B and FIG. 1C that, the greatest difference between the second embodiment and the first embodiment is that light-focusing curved surfaces are designed differently, and the curvatures of the light-focusing curved surfaces are changed such that axes along which light sources are projected through the light-focusing curved surfaces onto a reference line H of the lens structure 3 are changed.

As shown in FIG. 2A, in the second embodiment of the present disclosure, the lamp cup structure 1 has a first light-focusing curved surface 11, a second light-focusing curved surface 12, a third light-focusing curved surface 13, and a fourth light-focusing curved surface 14, where the lamp cup structure 1 may further have a first light-diffusing curved surface 15 disposed or connected between the second light-focusing curved surface 12 and the third light-focusing curved surface 13. Alternatively, the first light-focusing curved surface 11, the second light-focusing curved surface 12, the third light-focusing curved surface 13, and the fourth light-focusing curved surface 14 are directly connected to each other, but the present disclosure is not limited thereto.

Then, referring to FIG. 2B, a schematic top view of FIG. 2A is shown. The first light-focusing curved surface 11 has a first focal point F1 and a second focal point F2, the second light-focusing curved surface 12 has a third focal point F3 and a fourth focal point F4, the third light-focusing curved surface 13 has a fifth focal point F5 and a sixth focal point F6, the fourth light-focusing curved surface 14 has a seventh focal point F7 and an eighth focal point F8, where the first focal point F1 and the second focal point F2 are located on a first axis L1, the third focal point F3 and the fourth focal point F4 are located on a second axis F2, the fifth focal point F5 and the sixth focal point F6 are located on a third axis F3, and the seventh focal point F7 and the eighth focal point F8 are located on a fourth axis L4. In other words, the first axis L1, the second axis L2, the third axis L3, and the fourth axis L4 are each formed by connecting the focal points of the respective curved surfaces.

Further, the light-emitting structure 2 may be disposed in the lamp cup structure 1, where the light-emitting structure 2 includes a first light-emitting element 21, a second light-emitting element 22, a third light-emitting element 23, and a fourth light-emitting element 24. The first light-emitting element 21 may correspond to the first focal point F1 of the first light-focusing curved surface 11, the second light-emitting element 22 may correspond to the third focal point F3 of the second light-focusing curved surface 12, the third light-emitting element 23 may correspond to the fifth focal point F5 of the third light-focusing curved surface 13, and the fourth light-emitting element 24 may correspond to the seventh focal point F7 of the fourth light-focusing curved surface 14. Moreover, the lamp cup structure 1 and the light-emitting structure 2 may cooperate with a lens structure 3. The lens structure 3 may have a lens focal point F0, a primary optical axis V, and a reference line H. The lens focal point F0 is located at an intersection point of the primary optical axis V and the reference line H. The distance between the lens structure 3 and the reference line H is the distance from the lens focal point F0 to the lens structure 3. The primary optical axis V and the reference line H are disposed in perpendicular to each other and the reference line H and the lens structure 3 are disposed in parallel to each other. Due to the characteristics of the ellipse-based light-focusing curved surfaces, the second focal point F2, the fourth focal point F4, the sixth focal point F6, and the eighth focal point F8 in the lamp cup structure 1 are all located on the reference line H of the lens structure 3. In the second embodiment of the present disclosure, the curvatures of the first light-focusing curved surface 11, the second light-focusing curved surface 12, the third light-focusing curved surface 13, and the fourth light-focusing curved surface 14 are designed such that the lens focal point F0 converges with the second focal point F2 and the eighth focal point F8, and the fourth focal point F4 and the sixth focal point F6 are adjacent to two sides of the lens focal point F0 respectively, but the present disclosure is not limited thereto. Referring to FIG. 2C, the curvatures of the first light-focusing curved surface 11, the second light-focusing curved surface 12, the third light-focusing curved surface 13, and the fourth light-focusing curved surface 14 may be changed, so that the lens focal point F0 converges with the fourth focal point F4 and the sixth focal point F6, and the second focal point F2 and the eighth focal point F8 are adjacent to the two sides of the lens focal point F0 respectively. Therefore, a continuous light source in which the three points are connected to each other is formed for the lens structure 3.

It is noted that, the vehicle lamp module in the second embodiment of the present disclosure may further include a reflection structure 4 as described in first embodiment. As shown in FIG. 1D, the reflection structure 4 may include a first reflecting mirror 41. The first reflecting mirror 41 may be disposed between the second light-emitting element 22 and the third light-emitting element 23 in the second embodiment of the present disclosure. The first reflecting mirror 41 is disposed such that virtual images generated by the second light-emitting element 22 and the third light-emitting element 23 are presented in the first reflecting mirror 41. In other words, discrete light sources originally separated from a predetermined distance become a continuous light-emitting light source through connection by the reflection structure 4.

Because the curvatures of the light-focusing curved surfaces in the lamp cup structure 1 may be designed and the light-emitting structure 2 is correspondingly disposed at the focal points of the light-focusing curved surfaces, the vehicle lamp module C provided in the second embodiment of the present disclosure can be especially applicable to a discontinuous light-emitting diode package structure, so that relevant regulations are met, the manufacturing cost is reduced, and the illuminance, the lumens, and the projection distance of the light source are improved.

Third Embodiment

Figure 2D:
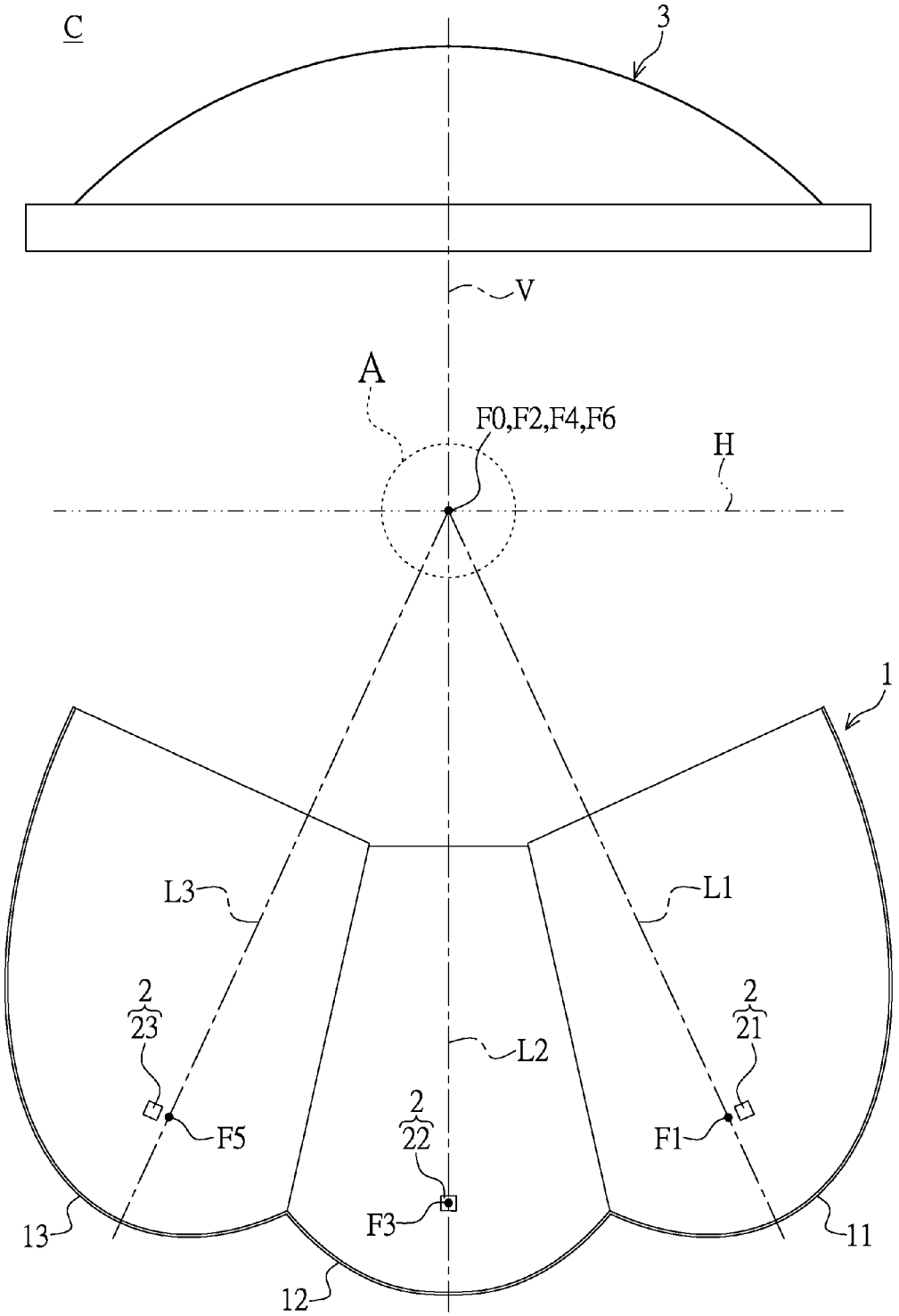
FIG. 2D is a schematic top view according to a third embodiment of the present disclosure.

Referring to FIG. 2D, a schematic top view of a third embodiment of the present disclosure is shown. It can be understood by comparing FIG. 2C and FIG. 2D that, the greatest difference between the third embodiment and the second embodiment of the present disclosure lies in the design of light-focusing curved surfaces and configuration relationships among light-focusing curved surfaces and light-emitting elements. In the third embodiment, the curvatures of the second light-focusing curved surface 12 and the third light-focusing curved surface 13 originally in the second embodiment may be changed, so that the second light-focusing curved surface 12 and the third light-focusing curved surface 13 have the same curvature and thus the same focal point.

As shown FIG. 2D, the third embodiment of the present disclosure provides a vehicle lamp module C, including a lamp cup structure 1, a light-emitting structure 2, and a lens structure 3. The lamp cup structure 1 has a first light-focusing curved surface 11, a second light-focusing curved surface 12, and a third light-focusing curved surface 13. The first light-focusing curved surface 11 has a first focal point F1 and a second focal point F2, the second light-focusing curved surface 12 has a third focal point F3 and a fourth focal point F4, and the third light-focusing curved surface 13 has a fifth focal point F5 and a sixth focal point F6, where the first focal point F1 and the second focal point F2 are located on a first axis L1, the third focal point F3 and the fourth focal point F4 are located on a second axis L2, and the fifth focal point F5 and the sixth focal point F6 are located on a third axis L3. In other words, the first axis L1, the second axis L2, and the third axis L3 are each formed by connecting the focal points of the respective curved surfaces.

Then, the lamp cup structure 1 may cooperate with a light-emitting structure 2. The light-emitting structure 2 may include a first light-emitting element 21, a second light-emitting element 22, and a third light-emitting element 23, where the first light-emitting element 21 corresponds to the first focal point F1, the second light-emitting element 22 corresponds to the third focal point F3, and the third light-emitting element 23 corresponds to the fifth focal point F5. Moreover, the lamp cup structure 1 and the light-emitting structure 2 may cooperate with a lens structure 3. The lens structure 3 may have a lens focal point F0, a primary optical axis V, and a reference line H. The lens focal point F0 is located at an intersection point of the primary optical axis V and the reference line H. The distance between the lens structure 3 and the reference line H is the distance from the lens focal point F0 to the lens structure 3. The primary optical axis V and the reference line H are disposed in perpendicular to each other and the reference line H and the lens structure 3 are disposed in parallel to each other. Due to the characteristics of the ellipse-based light-focusing curved surfaces, the second focal point F2, the fourth focal point F4, and the sixth focal point F6 in the lamp cup structure 1 are all located on the reference line H of the lens structure 3. Therefore, when a first light source generated by the first light-emitting element 21 is projected onto the first light-focusing curved surface 11, the first light source is reflected by the first light-focusing curved surface 11, forming a first reflection light source corresponding to the second focal point F2; when a second light source generated by the second light-emitting element 22 is projected onto the second light-focusing curved surface 12, the second light source is reflected by the second light-focusing curved surface 12, forming a second reflection light source corresponding to the fourth focal point F4; and when a third light source generated by the third light-emitting element 23 is projected onto the third light-focusing curved surface 13, the third light source is reflected by the third light-focusing curved surface 13, forming a third reflection light source corresponding to the sixth focal point F6. For example, in an application, the lens focal point F0 may converge with the fourth focal point F4, the second focal point F2 and the sixth focal point F6 are adjacent to two sides of the lens focal point F0 respectively, the first light-emitting element 21 is directly disposed at the first focal point F1, the second light-emitting element 22 is directly disposed at the third focal point F3, and the third light-emitting element 23 is directly disposed at the fifth focal point F5, so that a continuous light source in which the three points are connected to each other is directly projected onto the lens structure 3, but the present disclosure is not limited thereto.

Figure 2E:
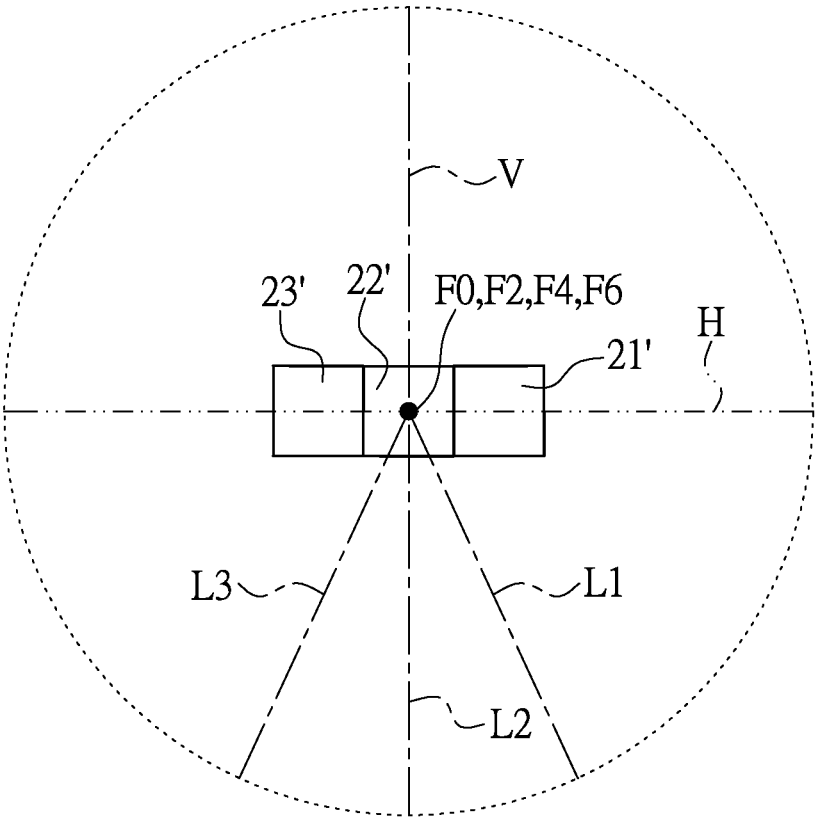
FIG. 2E is a schematic partially enlarged view of FIG. 2D according to the third embodiment of the present disclosure.

As shown in FIG. 2D, in the second embodiment of the present disclosure, the lens focal point F0 may converge with the second focal point F2, the fourth focal point F4, and the sixth focal point F6, so that the first axis L1, the second axis L2 and the third axis L3 intersect with each other at the lens focal point F0. Moreover, the first light-emitting element 21 is disposed adjacent to the first focal point F1, the second light-emitting element 22 is directly disposed at the third focal point F3, and the third light-emitting element 23 is disposed adjacent to the fifth focal point F5. Referring to FIG. 2E, a schematic partially enlarged view of part A in FIG. 2D is shown. As shown in FIG. 2E, light sources projected onto the reference line H by the first light-emitting element 21, the second light-emitting element 22, and the third light-emitting element 23 in the light-emitting structure 2 in FIG. 2D form a continuous light source in which a first light-emitting element 21', a second light-emitting element 22' and a third light-emitting element 23' are connected to each other for the lens structure 3.

Because the curvatures of the first light-focusing curved surface 11, the second light-focusing curved surface 12, and the third light-focusing curved surface 13 in the lamp cup structure 1 may be designed and the light-emitting structure 2 is correspondingly disposed at the focal points of the light-focusing curved surfaces, the vehicle lamp module C provided in the third embodiment of the present disclosure can cause light sources projected onto the lens structure 3 to form a continuous light source.

Fourth Embodiment

Figure 3A:
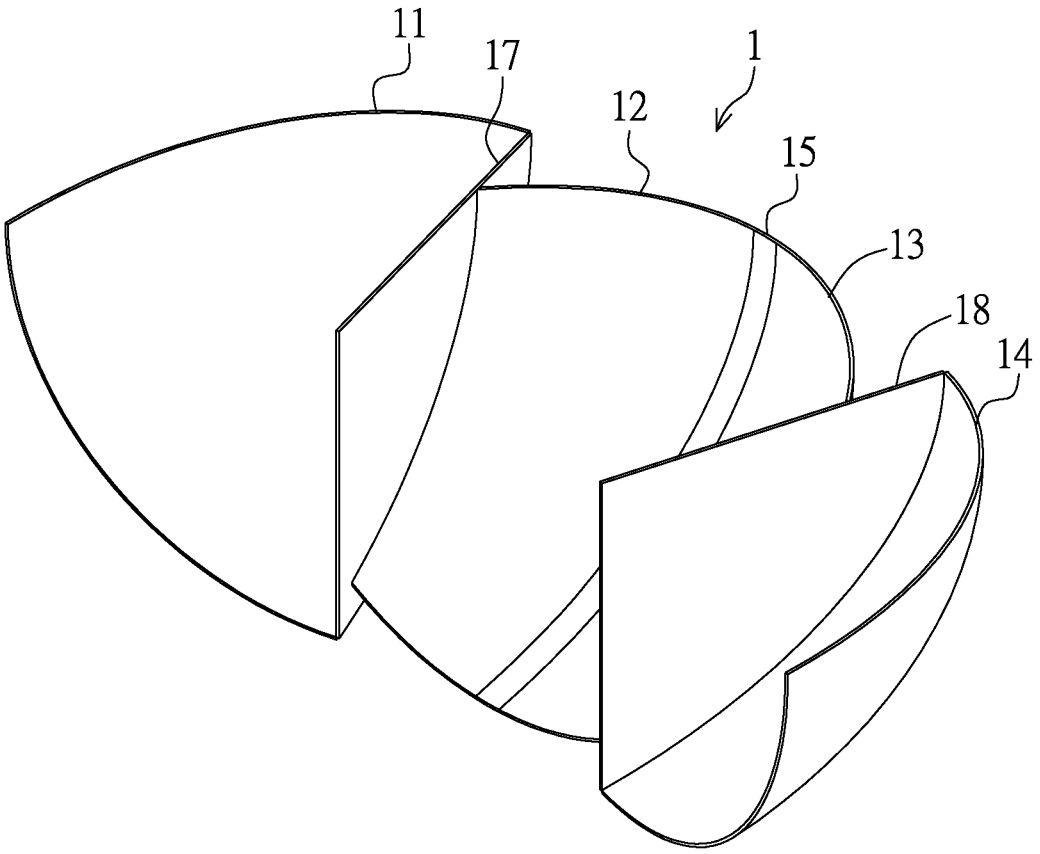
FIG. 3A is a schematic perspective view according to a fourth embodiment of the present disclosure.
Figure 3B:
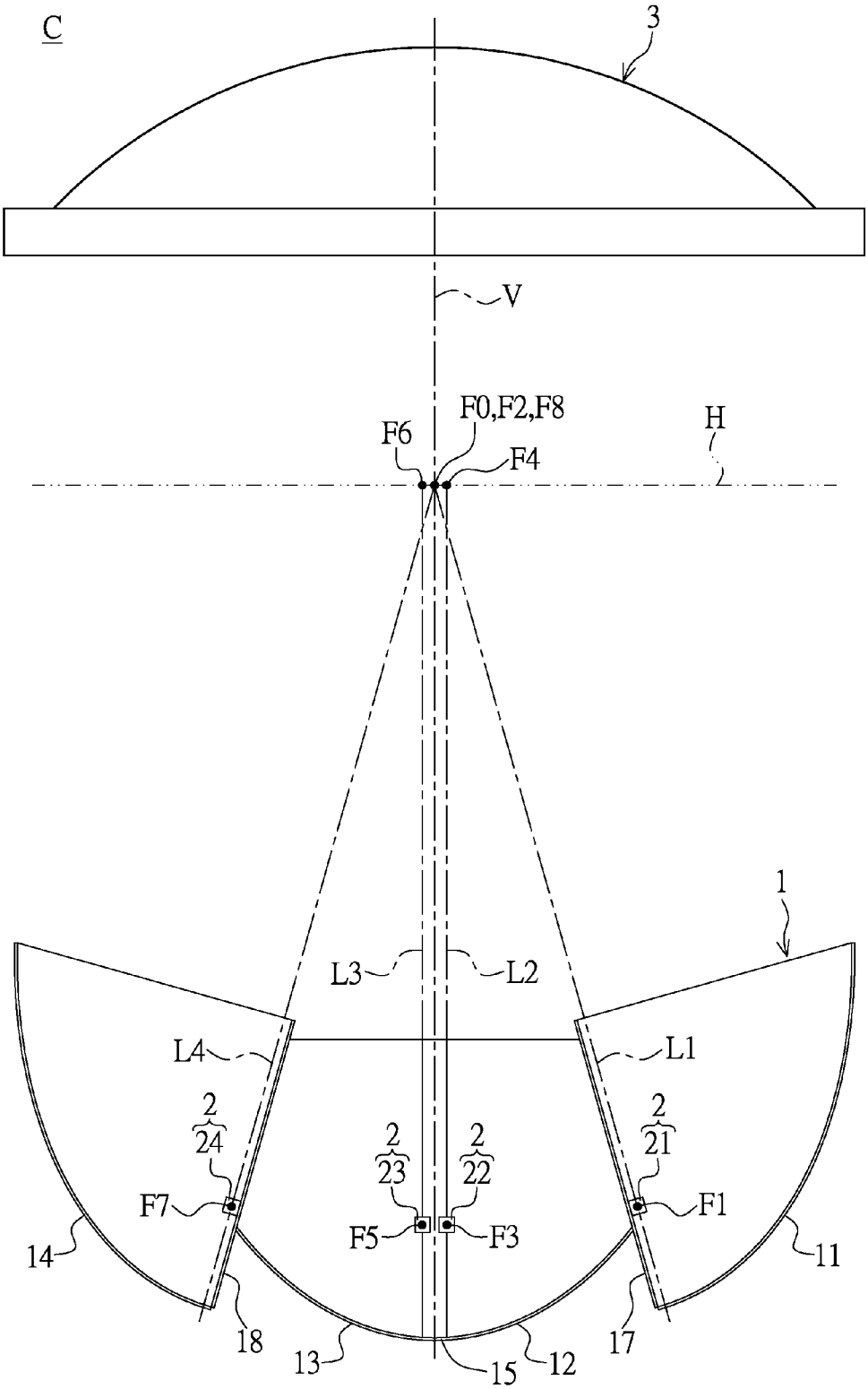
FIG. 3B is a schematic top view according to the fourth embodiment of the present disclosure.
Figure 3C:
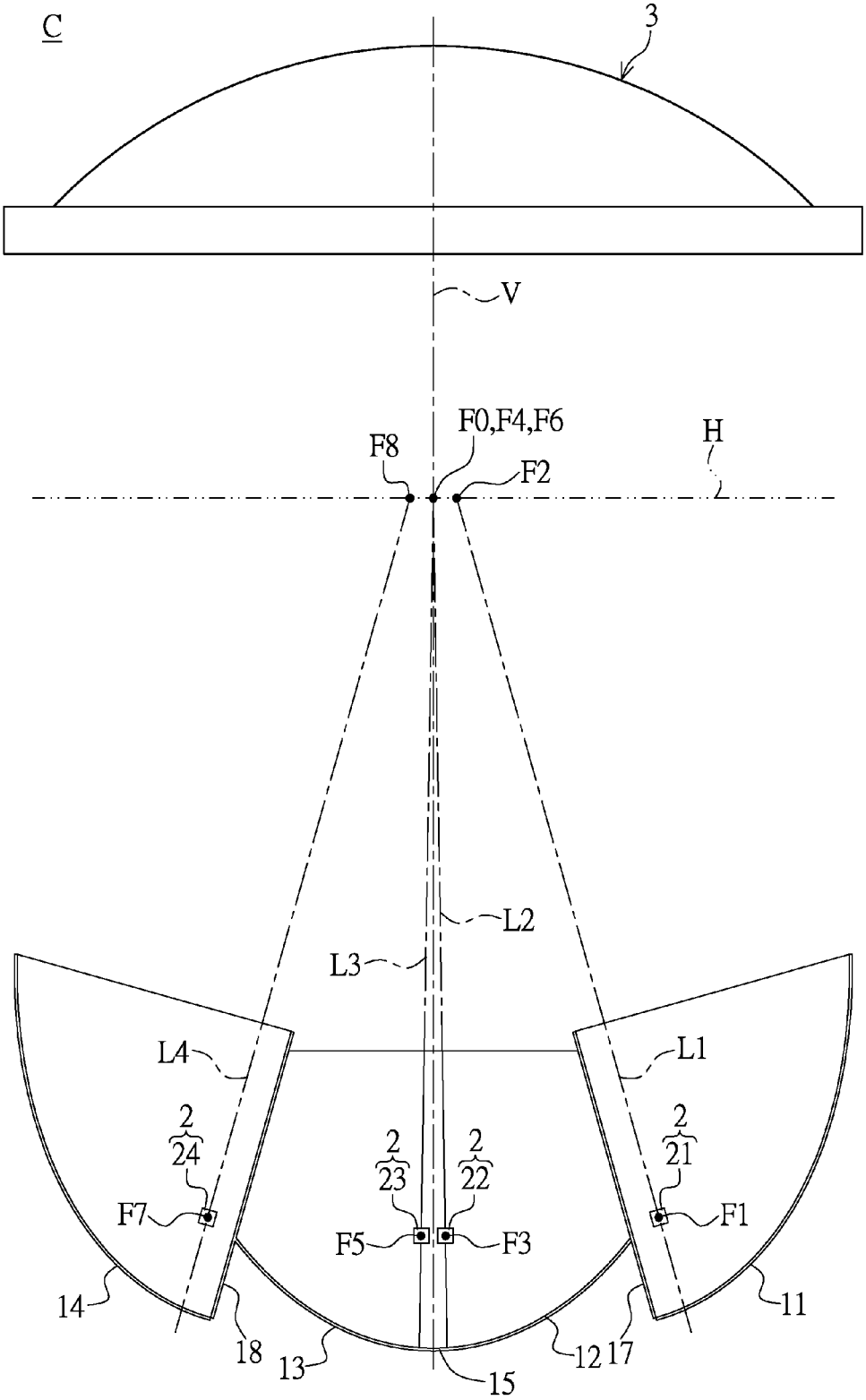
FIG. 3C is another schematic top view according to the fourth embodiment of the present disclosure.

Referring to FIG. 3A to FIG. 3C, a fourth embodiment of the present disclosure provides a vehicle lamp module C, including a lamp cup structure 1, a light-emitting structure 2, and a lens structure 3. It can be understood by comparing FIG. 3A and FIG. 2A that, the greatest difference between the fourth embodiment and the second embodiment of the present disclosure is that the lamp cup structure 1 in the fourth embodiment further includes a first reflecting plate 17 and a second reflecting plate 18.

Referring to FIG. 3A and FIG. 3B, the lamp cup structure 1 has a first light-focusing curved surface 11, a second light-focusing curved surface 12, a third light-focusing curved surface 13, a fourth light-focusing curved surface 14, a first reflecting plate 17, and a second reflecting plate 18. The first reflecting plate 17 may be disposed between the first light-focusing curved surface 11 and the second light-focusing curved surface 12 to connect the first light-focusing curved surface 11 and the second light-focusing curved surface 12, and the second reflecting plate 18 may be disposed between the third light-focusing curved surface 13 and the fourth light-focusing curved surface 14 to connect the third light-focusing curved surface 13 and the fourth light-focusing curved surface 14. The lamp cup structure 1 may further have a first light-diffusing curved surface 15 disposed or connected between the second light-focusing curved surface 12 and the third light-focusing curved surface 13. Then, the first light-focusing curved surface 11 has a first focal point F1 and a second focal point F2, the second light-focusing curved surface 12 has a third focal point F3 and a fourth focal point F4, the third light-focusing curved surface 13 has a fifth focal point F5 and a sixth focal point F6, and the fourth light-focusing curved surface 14 has a seventh focal point F7 and an eighth focal point F8. The first focal point F1 and the second focal point F2 are located on a first axis L1, the third focal point F3 and the fourth focal point F4 are located on a second axis L2, the fifth focal point F5 and the sixth focal point F6 are located on a third axis L3, and the seventh focal point F7 and the eighth focal point F8 are located on a fourth axis L4. In other words, the first axis L1, the second axis L2, the third axis L3, and the fourth axis L4 are each formed by connecting the focal points of the respective light-focusing curved surfaces. It is noted that, the light-focusing efficiency of the lamp cup structure 1 for the light-emitting structure 2 can be improved by providing the first reflecting plate 17 and the second reflecting plate 18.

Then, the lamp cup structure 1 may cooperate with a light-emitting structure 2 and a lens structure 3. A first light-emitting element 21 in the light-emitting structure 2 corresponds to the first focal point F1, a second light-emitting element 22 corresponds to the third focal point F3, a third light-emitting element 23 corresponds to the fifth focal point F5, and a fourth light-emitting element 24 corresponds to the seventh focal point F7. Moreover, the second focal point F2, the fourth focal point F4, the sixth focal point F6, and the eighth focal point F8 in the lamp cup structure 1 are all located on a reference line H of the lens structure 3. Therefore, when a first light source generated by the first light-emitting element 21 is projected onto the first light-focusing curved surface 11, the first light source is reflected by the first light-focusing curved surface 11, forming a first reflection light source corresponding to the second focal point F2; when a second light source generated by the second light-emitting element 22 is projected onto the second light-focusing curved surface 12, the second light source is reflected by the second light-focusing curved surface 12, forming a second reflection light source corresponding to the fourth focal point F4; when a third light source generated by the third light-emitting element 23 is projected onto the third light-focusing curved surface 13, the third light source is reflected by the third light-focusing curved surface 13, forming a third reflection light source corresponding to the sixth focal point F6; and when a fourth light source generated by the fourth light-emitting element 24 is projected onto the fourth light-focusing curved surface 14, the fourth light source is reflected by the fourth light-focusing curved surface 14, forming a fourth reflection light source corresponding to the eighth focal point F8.

It is noted that, in the second embodiment of the present disclosure, the curvatures of the first light-focusing curved surface 11, the second light-focusing curved surface 12, the third light-focusing curved surface 13, and the fourth light-focusing curved surface 14 may be designed such that a lens focal point F0 converges with the second focal point F2 and the eighth focal point F8, and the fourth focal point F4 and the sixth focal point F6 are adjacent to two sides of the lens focal point F0 respectively, but the present disclosure is not limited thereto. Referring to FIG. 3C, the curvatures of the first light-focusing curved surface 11, the second light-focusing curved surface 12, the third light-focusing curved surface 13, and the fourth light-focusing curved surface 14 may be changed, so that the lens focal point F0 converges with the fourth focal point F4 and the sixth focal point F6, and the second focal point F2 and the eighth focal point F8 are adjacent to the two sides of the lens focal point F0 respectively. Therefore, a continuous light source in which the three points are connected to each other is formed for the lens structure 3.

Because the curvatures of the first light-focusing curved surface 11, the second light-focusing curved surface 12, the third light-focusing curved surface 13, and the fourth light-focusing curved surface 14, the first reflecting plate 17, and the second reflecting plate 18 in the lamp cup structure 1 may be designed, the vehicle lamp module C provided in the fourth embodiment of the present disclosure can cause light sources projected onto the lens structure 3 to form a continuous light source and thus can improve the light focusing efficiency for the light-emitting structure 2.

Fifth Embodiment

Figure 3D:
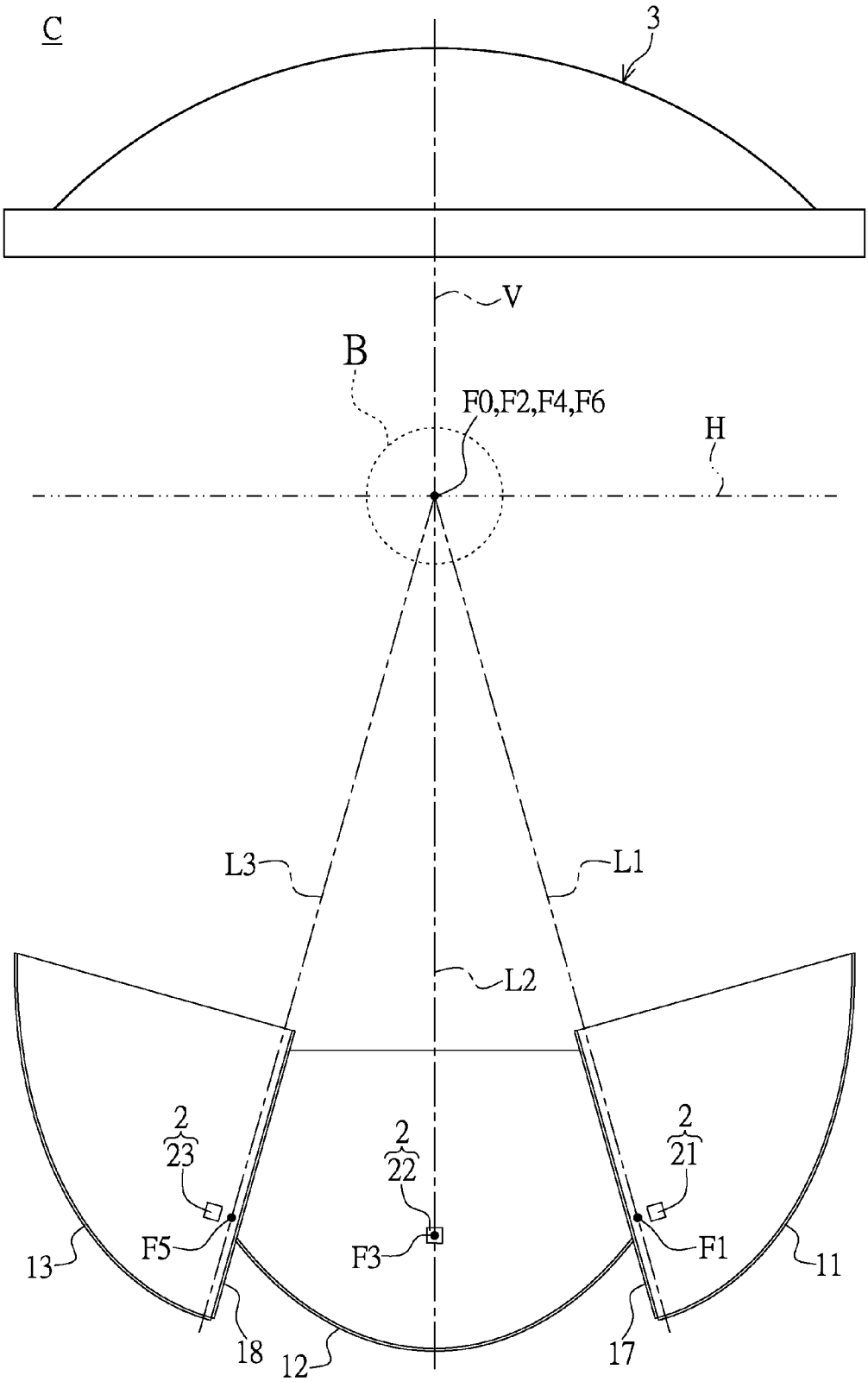
FIG. 3D is a schematic top view according to a fifth embodiment of the present disclosure.
Figure 3E:
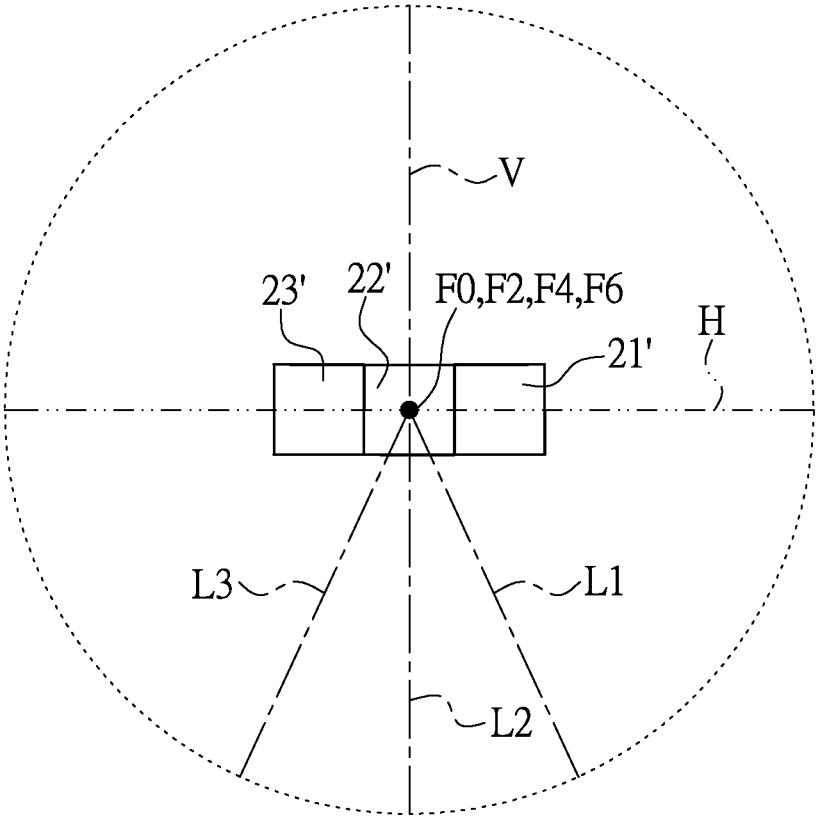
FIG. 3E is a schematic partially enlarged view of FIG. 3D according to the fifth embodiment of the present disclosure.

Referring to FIG. 3D to FIG. 3E, it can be understood by comparing FIG. 3D and FIG. 3C that, the greatest difference between the fifth embodiment and the fourth embodiment of the present disclosure lies in the design of light-focusing curved surfaces and configuration relationships among light-focusing curved surfaces and light-emitting elements. In the fifth embodiment, the curvatures of the second light-focusing curved surface 12 and the third light-focusing curved surface 13 originally in the fourth embodiment may be changed, so that the second light-focusing curved surface 12 and the third light-focusing curved surface 13 have the same curvature and thus the same focal point.

As shown FIG. 3D, the fifth embodiment of the present disclosure provides a vehicle lamp module C, including a lamp cup structure 1, a light-emitting structure 2, and a lens structure 3. The lamp cup structure 1 has a first light-focusing curved surface 11, a second light-focusing curved surface 12, a third light-focusing curved surface 13, a first reflecting plate 17, and a second reflecting plate 18. The first reflecting plate 17 may be disposed between the first light-focusing curved surface 11 and the second light-focusing curved surface 12 to connect the first light-focusing curved surface 11 and the second light-focusing curved surface 12, and the second reflecting plate 18 may be disposed between the second light-focusing curved surface 12 and the third light-focusing curved surface 13 to connect the second light-focusing curved surface 12 and the third light-focusing curved surface 13. The light-focusing efficiency of the lamp cup structure 1 for the light-emitting structure 2 can be improved by providing the first reflecting plate 17 and the second reflecting plate 18. The first light-focusing curved surface 11 has a first focal point F1 and a second focal point F2, the second light-focusing curved surface 12 has a third focal point F3 and a fourth focal point F4, and the third light-focusing curved surface 13 has a fifth focal point F5 and a sixth focal point F6, where the first focal point F1 and the second focal point F2 are located on a first axis L1, the third focal point F3 and the fourth focal point F4 are located on a second axis L2, and the fifth focal point F5 and the sixth focal point F6 are located on a third axis L3. In other words, the first axis L1, the second axis L2, and the third axis L3 are each formed by connecting the focal points of the respective curved surfaces.

Then, the lamp cup structure 1 may cooperate with a light-emitting structure 2. The light-emitting structure 2 may include a first light-emitting element 21, a second light-emitting element 22, and a third light-emitting element 23, where the first light-emitting element 21 corresponds to the first focal point F1, the second light-emitting element 22 corresponds to the third focal point F3, and the third light-emitting element 23 corresponds to the fifth focal point F5. Moreover, the lamp cup structure 1 and the light-emitting structure 2 may cooperate with a lens structure 3. The lens structure 3 may have a lens focal point F0, a primary optical axis V, and a reference line H. The lens focal point F0 is located at an intersection point of the primary optical axis V and the reference line H. The distance between the lens structure 3 and the reference line H is the distance from the lens focal point F0 to the lens structure 3. The primary optical axis V and the reference line H are disposed in perpendicular to each other and the reference line H and the lens structure 3 are disposed in parallel to each other. Due to the characteristics of the ellipse-based light-focusing curved surfaces, the second focal point F2, the fourth focal point F4, and the sixth focal point F6 in the lamp cup structure 1 are all located on the reference line H of the lens structure 3. Therefore, when a first light source generated by the first light-emitting element 21 is projected onto the first light-focusing curved surface 11, the first light source is reflected by the first light-focusing curved surface 11, forming a first reflection light source corresponding to the second focal point F2; when a second light source generated by the second light-emitting element 22 is projected onto the second light-focusing curved surface 12, the second light source is reflected by the second light-focusing curved surface 12, forming a second reflection light source corresponding to the fourth focal point F4; and when a third light source generated by the third light-emitting element 23 is projected onto the third light-focusing curved surface 13, the third light source is reflected by the third light-focusing curved surface 13, forming a third reflection light source corresponding to the sixth focal point F6. For example, as shown in FIG. 3D, the lens focal point F0 may converge with the second focal point F2, the fourth focal point F4, and the sixth focal point F6, so that the first axis L1, the second axis L2 and the third axis L3 intersect with each other at the lens focal point F0. Then, the first light-emitting element 21 is disposed adjacent to the first focal point F1, the second light-emitting element 22 is directly disposed at the third focal point F3, and the third light-emitting element 23 is disposed adjacent to the fifth focal point F5. Referring to FIG. 3E, a schematic partially enlarged view of part B in FIG. 3D is shown. As shown in FIG. 3E, light sources projected onto the reference line H by the first light-emitting element 21, the second light-emitting element 22, and the third light-emitting element 23 in the light-emitting structure 2 in FIG. 3D form a continuous light source in which a first light-emitting element 21', a second light-emitting element 22' and a third light-emitting element 23' are connected to each other for the lens structure 3.

Because the curvatures of the first light-focusing curved surface 11, the second light-focusing curved surface 12, and the third light-focusing curved surface 13, the first reflecting plate 17, and the second reflecting plate 18 in the lamp cup structure 1 may be designed and the position of the light-emitting structure 2 provided on the lamp cup structure may be changed, the vehicle lamp module C provided in the fifth embodiment of the present disclosure can cause light sources projected onto the lens structure 3 to form a continuous light source and thus can improve the light focusing efficiency for the light-emitting structure 2.

Sixth Embodiment

Figure 4A:
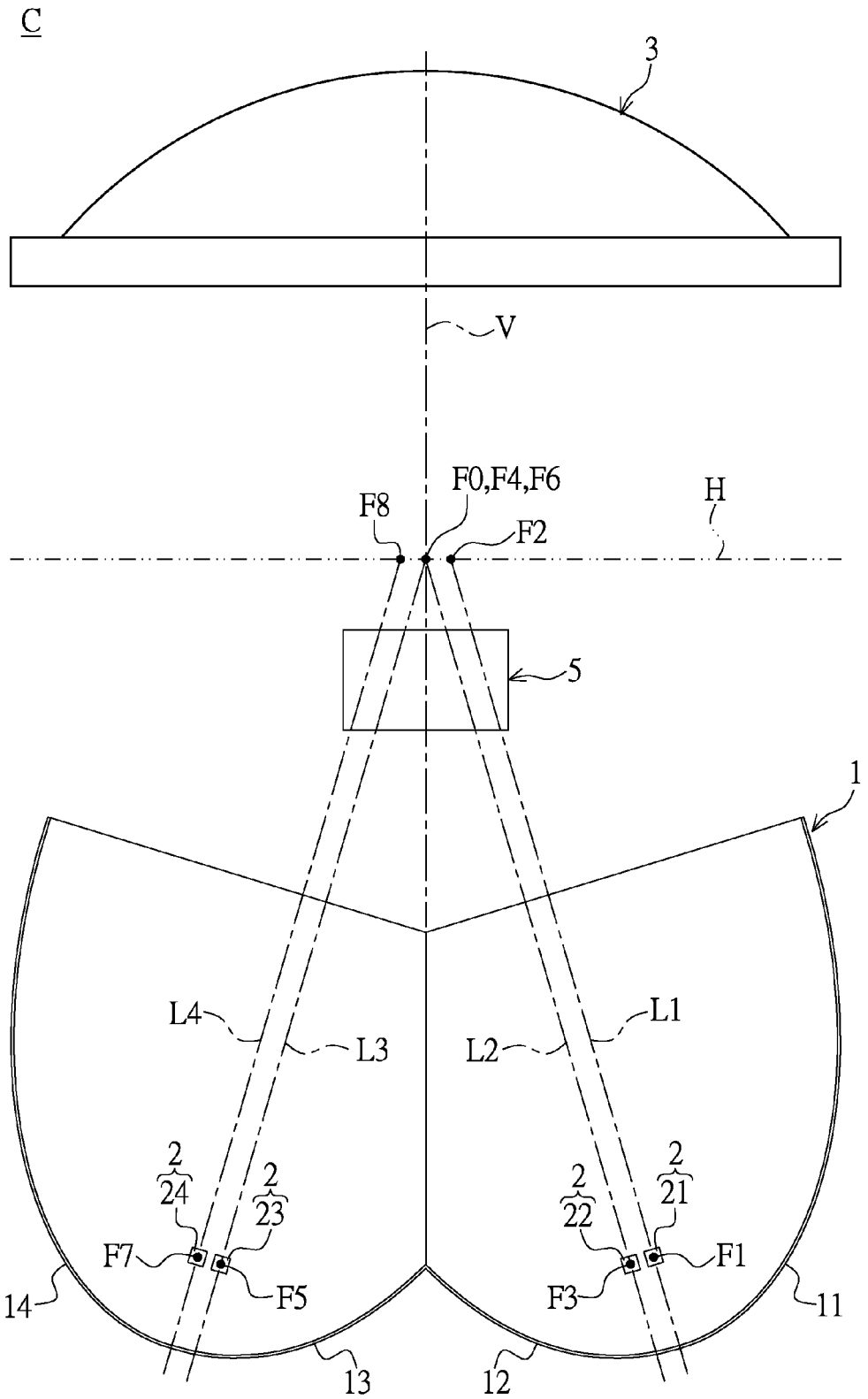
FIG. 4A is a schematic top view according to a sixth embodiment of the present disclosure.
Figure 4B:
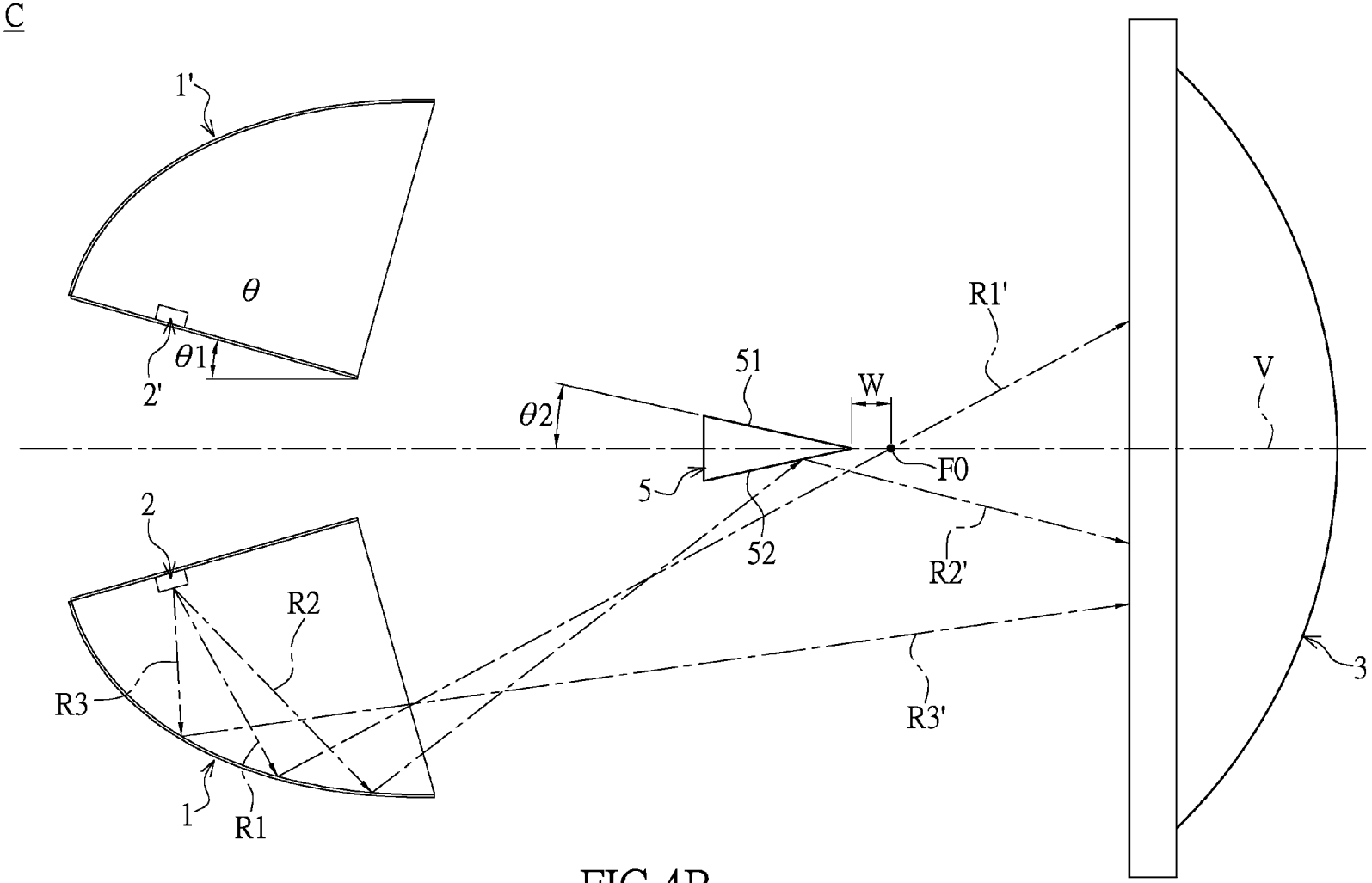
FIG. 4B is a schematic side view according to the sixth embodiment of the present disclosure.

Referring to FIG. 4A to FIG. 4B, a sixth embodiment of the present disclosure provides a vehicle lamp module C, including two lamp cup structures 1, 1', two light-emitting structures 2, 2', a lens structure 3, and a light beam adjusting structure 5. It can be understood by comparing FIG. 4A, FIG. 4B, and FIG. 1C that, compared with the first embodiment, the sixth embodiment further includes a light beam adjusting structure 5, the additional lamp cup structure 1', and the additional light-emitting structure 2'. It should be noted that, any one of the lamp cup structures 1 in the first embodiment to the fifth embodiment may be directly used as the lamp cup structure 1 in the sixth embodiment. In the sixth embodiment of the present disclosure, the light beam adjusting structure 5 is disposed on a primary optical axis V adjacent to a lens focal point F0, and may be a wedge-shaped centrum. The light beam adjusting structure 5 may have a reflecting surface for reflecting light sources emitted by the light-emitting modules 2, 2'. For example, the reflecting surface may include an upper reflecting surface 51 and a lower reflecting surface 52, where the upper reflecting surface 51 and the lower reflecting surface 52 are specular surfaces. When the light sources generated by the light-emitting structures 2, 2' are projected onto light-focusing curved surfaces, the light sources are reflected by the light-focusing curved surfaces, forming reflection light sources. One of functions of the light beam adjusting structure 5 is that reflection light sources originally not passing through the lens structure 3 but projected onto two sides of the lens structure 3 are specularly reflected by the upper reflecting surface 51 and the lower reflecting surface 52 so that the reflection light sources pass through the lens structure 3 through specular reflection, thereby improving the light-focusing efficiency.

Referring to FIG. 4B, the lamp cup structure 1 and the lamp cup structure 1' are arranged along two sides of the primary optical axis V in a such manner that a tilt angle θ1 is formed between each of the lamp cup structure 1 and the lamp cup structure 1' and the primary optical axis V, and an inclination θ2 is formed between the upper reflecting surface 51 of the light beam adjusting structure 5 and the primary optical axis V. The inclination θ2 of the light beam adjusting structure 5 may be the same as the tilt angle θ1 of the lamp cup structure 1, or may also be greater than or less than the tilt angle θ1 of the lamp cup structure 1. However, preferably, the inclination θ2 of the light beam adjusting structure 5 is not greater than two times the tilt angle θ1 of the lamp cup structure 1 and not less than ¼ of the tilt angle θ1 of the lamp cup structure 1. It is noted that, the light beam adjusting structure 5 is disposed adjacent to the lens focal point F0 of the lens structure 3, where a front end, that is, an apex of the wedge-shaped centrum, of the light beam adjusting structure 5 is separated from the lens focal point F0 of the lens structure 3 at a spacing distance W. The spacing distance W is approximately between 0.5 mm and 1 mm. It is noted that, a heat dissipation structure may be disposed between the lamp cup structure 1 and the lamp cup structure 1', and a substrate S is disposed on the heat dissipation structure for the light-emitting structure 2 and the light-emitting structure 2' to be disposed thereon, thereby dissipating heat from the light-emitting structures 2, 2' through the heat dissipation structure.

Then, referring to FIG. 4A and FIG. 4B, as described in the first embodiment, the lamp cup structure 1 has a first light-focusing curved surface 11, a second light-focusing curved surface 12, a third light-focusing curved surface 13, and a fourth light-focusing curved surface 14, a first light-diffusing curved surface 15 disposed or connected between the first light-focusing curved surface 11 and the second light-focusing curved surface 12, and a second light-diffusing curved surface 16 disposed or connected between the third light-focusing curved surface 13 and the fourth light-focusing curved surface 14. Similarly, the lamp cup structure 1' also has the light-focusing curved surfaces. As described in the first embodiment, the light-emitting structure 2 is also correspondingly disposed in the lamp cup structure 1, and the light-emitting structure 2' is also correspondingly disposed in the lamp cup structure V. For example, a first light ray R1, a second light ray R2, and a third light ray R3 generated by the light-emitting structure 2 are reflected by the light-focusing curved surfaces of the lamp cup structure 1, so that a first light ray R1', a second light ray R2', and a third light ray R3' all pass through the lens structure 3, where the second light ray R2 generated by the light-emitting structure 2 is specularly reflected by the light beam adjusting structure 5 to generate a second light ray R2', which is reflected to the lens structure 3 and thereby pass through the lens structure 3.

In the vehicle lamp module C provided in the sixth embodiment of the present disclosure, the light beam adjusting structure 5 is provided in combination with the lamp cup structures 1, 1' and the light-emitting structures 2, 2', so that reflection light sources originally not passing through the lens structure 3 are reflected by the upper reflecting surface 51 and the lower reflecting surface 52 of the light beam adjusting structure 5 to pass through the lens structure 3, thereby improving the light-focusing efficiency. Meanwhile, the vehicle lamp module C in the sixth embodiment of the present disclosure can be especially applicable to a high-beam lamp system. Compared with a traditional high-beam lamp system, the high-beam lamp system using the vehicle lamp module C enables the size of the vehicle lamp module to be reduced, and because multiple light-focusing curved surfaces are disposed, multiple light-emitting elements can be used, thereby improving the illuminance, the lumens, and the projection distance of the light source.

Possible Effects of the Embodiments

In sum, the beneficial effect of the present disclosure is that, the vehicle lamp module C provided by the present disclosure can be especially applicable to a discontinuous light-emitting diode package structure, and the light-emitting elements may be correspondingly disposed at the focal points of the light-reflecting surfaces in the vehicle cup structure 1, so that relevant regulations are met, the manufacturing cost is reduced, and the illuminance, the lumens, and the projection distance of the light source are improved.

The above description is only intended to provide the preferred embodiments of the present disclosure, and is not to limit the patent scope of the present disclosure. All equivalent technical variations made according to the specification and drawings of the present disclosure fall within the protection scope of the present disclosure.

What is claimed is:

1. A vehicle lamp module, comprising:

a lamp cup structure having a first light-focusing curved surface, a second light-focusing curved surface, a third light-focusing curved surface, and a fourth light-focusing curved surface, wherein the first light-focusing curved surface has a first focal point and a second focal point, the second light-focusing curved surface has a third focal point and a fourth focal point, the third light-focusing curved surface has a fifth focal point and a sixth focal point, and the fourth light-focusing curved surface has a seventh focal point and an eighth focal point, wherein the first focal point and the second focal point are located on a first axis, the third focal point and the fourth focal point are located on a second axis, the fifth focal point and the sixth focal point are located on a third axis, and the seventh focal point and the eighth focal point are located on a fourth axis;

a light-emitting structure including a first light-emitting element, a second light-emitting element, a third light-emitting element, and a fourth light-emitting element, wherein the first light-emitting element corresponds to the first focal point, the second light-emitting element corresponds to the third focal point, the third light-emitting element corresponds to the fifth focal point, and the fourth light-emitting element corresponds to the seventh focal point; and a lens structure having a lens focal point, a primary optical axis, and a reference line, wherein the lens focal point is located at an intersection point of the primary optical axis and the reference line and the reference line is parallel to the lens structure, wherein the second focal point, the fourth focal point, the sixth focal point, and the eighth focal point are all located on the reference line, and a first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, a third light source generated by the third light-emitting element is projected onto the third light-focusing curved surface to form a third reflection light source corresponding to the sixth focal point, and a fourth light source generated by the fourth light-emitting element is projected onto the fourth light-focusing curved surface to form a fourth reflection light source corresponding to the eighth focal point.

2. The vehicle lamp module according to claim 1, wherein the lens focal point converges with the fourth focal point and the sixth focal point, and the second focal point and the eighth focal point are adjacent to two sides of the lens focal point respectively.

3. The vehicle lamp module according to claim 1, wherein the lens focal point converges with the second focal point and the eighth focal point, and the fourth focal point and the sixth focal point are adjacent to two sides of the lens focal point respectively.

4. The vehicle lamp module according to claim 1, wherein the first light-emitting element is disposed adjacent to or directly at the first focal point, the second light-emitting element is disposed adjacent to or directly at the third focal point, the third light-emitting element is disposed adjacent to or directly at the fifth focal point, and the fourth light-emitting element is disposed adjacent to or directly at the seventh focal point.

5. The vehicle lamp module according to claim 1, further comprising a reflection structure including a first reflecting mirror and a second reflecting mirror, wherein the first reflecting mirror is disposed between the first light-emitting element and the second light-emitting element, and the second reflecting mirror is disposed between the third light-emitting element and the fourth light-emitting element.

6. The vehicle lamp module according to claim 1, further comprising a light beam adjusting structure, wherein the light beam adjusting structure is disposed on the primary optical axis adjacent to the lens focal point and has a reflecting surface.

7. A vehicle lamp module, comprising:

a lamp cup structure having a first light-focusing curved surface, a second light-focusing curved surface, a third light-focusing curved surface, a fourth light-focusing curved surface, a first reflecting plate, and a second reflecting plate, wherein the first reflecting plate is disposed between the first light-focusing curved surface and the second light-focusing curved surface to connect the first light-focusing curved surface and the second light-focusing curved surface, and the second reflecting plate is disposed between the third light-focusing curved surface and the fourth light-focusing curved surface to connect the third light-focusing curved surface and the fourth light-focusing curved surface; wherein the first light-focusing curved surface has a first focal point and a second focal point, the second light-focusing curved surface has a third focal point and a fourth focal point, the third light-focusing curved surface has a fifth focal point and a sixth focal point, and the fourth light-focusing curved surface has a seventh focal point and an eighth focal point, wherein the first focal point and the second focal point are located on a first axis, the third focal point and the fourth focal point are located on a second axis, the fifth focal point and the sixth focal point are located on a third axis, and the seventh focal point and the eighth focal point are located on a fourth axis;

a light-emitting structure including a first light-emitting element, a second light-emitting element, a third light-emitting element, and a fourth light-emitting element, wherein the first light-emitting element corresponds to the first focal point, the second light-emitting element corresponds to the third focal point, the third light-emitting element corresponds to the fifth focal point, and the fourth light-emitting element corresponds to the seventh focal point; and a lens structure having a lens focal point, a primary optical axis, and a reference line, wherein the lens focal point is located at an intersection point of the primary optical axis and the reference line and the reference line is parallel to the lens structure, wherein the second focal point, the fourth focal point, the sixth focal point, and the eighth focal point are all located on the reference line, and a first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, a third light source generated by the third light-emitting element is projected onto the third light-focusing curved surface to form a third reflection light source corresponding to the sixth focal point, and a fourth light source generated by the fourth light-emitting element is projected onto the fourth light-focusing curved surface to form a fourth reflection light source corresponding to the eighth focal point.

8. The vehicle lamp module according to claim 7, wherein the lens focal point converges with the second focal point, the fourth focal point, the sixth focal point, and the eighth focal point, the first light-emitting element is adjacent to the first focal point, and the fourth light-emitting element is adjacent to the seventh focal point.

9. The vehicle lamp module according to claim 7, wherein the first light-emitting element is disposed adjacent to or directly at the first focal point, the second light-emitting element is disposed adjacent to or directly at the third focal point, the third light-emitting element is disposed adjacent to or directly at the fifth focal point, and the fourth light-emitting element is disposed adjacent to or directly at the seventh focal point.

10. A vehicle lamp module, comprising:

a lamp cup structure having a first light-focusing curved surface, a second light-focusing curved surface, and a third light-focusing curved surface, wherein the first light-focusing curved surface has a first focal point and a second focal point, the second light-focusing curved surface has a third focal point and a fourth focal point, and the third light-focusing curved surface has a fifth focal point and a sixth focal point, wherein the first focal point and the second focal point are located on a first axis, the third focal point and the fourth focal point are located on a second axis, and the fifth focal point and the sixth focal point are located on a third axis;

a light-emitting structure including a first light-emitting element, a second light-emitting element, and a third light-emitting element, wherein the first light-emitting element corresponds to the first focal point, the second light-emitting element corresponds to the third focal point, and the third light-emitting element corresponds to the fifth focal point; and a lens structure having a lens focal point, a primary optical axis, and a reference line, wherein the lens focal point is located at an intersection point of the primary optical axis and the reference line and the reference line is parallel to the lens structure, wherein the second focal point, the fourth focal point, and the sixth focal point are all located on the reference line, and a first light source generated by the first light-emitting element is projected onto the first light-focusing curved surface to form a first reflection light source corresponding to the second focal point, a second light source generated by the second light-emitting element is projected onto the second light-focusing curved surface to form a second reflection light source corresponding to the fourth focal point, and a third light source generated by the third light-emitting element is projected onto the third light-focusing curved surface to form a third reflection light source corresponding to the sixth focal point.

11. The vehicle lamp module according to claim 10, wherein the first light-emitting element is disposed adjacent to or directly at the first focal point, the second light-emitting element is disposed directly at the third focal point, and the third light-emitting element is disposed adjacent to or directly at the fifth focal point.

* * * * *